US008804175B2

(12) United States Patent
Yamauchi

(10) Patent No.: US 8,804,175 B2
(45) Date of Patent: Aug. 12, 2014

(54) PRINTER, PRINTING CONTROL METHOD, AND COMPUTER-READABLE RECORDING MEDIUM

(75) Inventor: Junichi Yamauchi, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 110 days.

(21) Appl. No.: 13/587,767

(22) Filed: Aug. 16, 2012

(65) Prior Publication Data

US 2013/0107317 A1 May 2, 2013

(30) Foreign Application Priority Data

Oct. 31, 2011 (JP) ..... 2011-238889

(51) Int. Cl.
*B41J 11/48* (2006.01)
*B41J 13/10* (2006.01)

(52) U.S. Cl.
CPC ..... *B41J 11/485* (2013.01); *B41J 13/106* (2013.01)
USPC ..... 358/1.15; 358/498

(58) Field of Classification Search
USPC ..... 358/1.15, 498
See application file for complete search history.

(56) References Cited

U.S. PATENT DOCUMENTS

| | | | | |
|---|---|---|---|---|
| 7,703,759 | B2 * | 4/2010 | Butler, Jr. | 271/9.13 |
| 8,020,865 | B2 * | 9/2011 | Bober et al. | 271/272 |
| 2007/0132170 | A1 * | 6/2007 | Butler, Jr. | 271/9.01 |
| 2010/0075820 | A1 * | 3/2010 | De Matteis | 493/360 |
| 2010/0187753 | A1 * | 7/2010 | Suzuki | 271/265.02 |
| 2011/0310206 | A1 * | 12/2011 | Samoto et al. | 347/104 |

FOREIGN PATENT DOCUMENTS

| | | | | |
|---|---|---|---|---|
| JP | 11-199124 | A | 7/1999 | |
| JP | 2001-047690 | A | 2/2001 | |
| JP | 2003-312903 | * | 11/2003 | B65H 9/14 |
| JP | 2004-238120 | A | 8/2004 | |

* cited by examiner

*Primary Examiner* — Jerome Grant, II
(74) *Attorney, Agent, or Firm* — Maschoff Brennan

(57) ABSTRACT

A printer includes a first feeder that feeds a first sheet, a second feeder that feeds a second sheet, a feed position on the second feeder being set so that the second sheet overlaps the first sheet when the second sheet is ejected, a stacker that collects the first sheet and the second sheet on which printing has been carried out so that the first sheet and the second sheet overlap, and a processor that determines whether a sectioning command is included in a print request, and when a sectioning command is included, switches over between the first feeder and the second feeder for each print job.

10 Claims, 23 Drawing Sheets

PRINTER, PRINTING CONTROL METHOD, AND COMPUTER-READABLE RECORDING MEDIUM

CROSS-REFERENCE TO RELATED APPLICATION

This application is based upon and claims the benefit of priority of the prior Japanese Patent Application No. 2011-238889, filed on Oct. 31, 2011, the entire contents of which are incorporated herein by reference.

FIELD

The embodiments discussed herein are related to a printer, a printing control method, and a computer-readable recording medium.

BACKGROUND

When, for example, a plurality of copies of print data with the same structure are printed by a serial printer, printed sheets are ejected by being stacked at a given position on an ejection side. During the ejection of the printed sheets, the sheets are sorted for each copy or a plurality of printed sheets of the same page are stacked together. When printing a plurality of copies on a serial printer, therefore, the user manually separates the ejected sheets for each copy.

To simplify the sectioning of printed sheets that have been ejected together as described above for each copy, some serial printers have a sheet inverting unit that places ejected sheets with the printed surface either facing up or facing down. Other serial printer's prints change the sequence in which print data is printed each time one copy is printed so that copies are distinguished by a difference in printed surfaces.

To separate ejected sheets, a known printer uses a normal sort function that moves printed sheets to the right and left relative to the ejection direction and also switches between a feed tray in which print sheets are placed in a portrait orientation and a feed tray in which print sheets are placed in a landscape orientation each time one copy has been printed, with the print sheets being of the same size, each time one copy has been printed, as disclosed in Japanese Laid-open Patent Publication No. 2001-047690.

With a printer that may feed print sheets of the same size in the long-side direction and short-side direction, odd-numbered copies are fed in the short-side direction and even-numbered copies are fed in the long-side direction, as disclosed in Japanese Laid-open Patent Publication No. 11-199124.

A known shifter mechanism ejects printed sheets with an offset, which is made by an ejection roller, from a plurality of ejection positions that are set along a direction orthogonal to a sheet transport direction, as disclosed in Japanese Laid-open Patent Publication No. 2004-238120.

The serial printer carries out printing and ejection as a series of processes. The print head having head pins is placed to match the print position on the print sheet and moves in a primary scanning direction. The print sheet is transported in a secondary-scanning direction so that the print position moves to the next line and printing is carried out. With the serial printer, therefore, the position at which the sheet is placed is not changed during the printing process.

When a serial printer has, in a stacker, a mechanism that changes the sheet ejection position, the mechanism comes into contact with the sheet that is being printed, making it hard to change the ejection position. The mechanism may cause a print error. When printing processing is suspended during shift processing, a time loss may arise during printing processing. When a sheet inverting unit as described above is placed on, for example, a transport path that follows after print processing, the addition of a constituent part of this type may enlarge the printer and complicate the transport path. Since inverted print sheets are ejected at the same position on the stacker, confirmation of the sectioning position for each copy is desired.

In addition, with a serial printer, if the unit that changes the ejection position is set to operate automatically, control processing based on data to be printed is desirable.

SUMMARY

According to an aspect of embodiments, a printer includes a first feeder that feeds a first sheet, a second feeder that feeds a second sheet, a feed position on the second feeder being set so that the second sheet overlaps the first sheet when the second sheet is ejected, a stacker that collects the first sheet and the second sheet on which printing has been carried out so that the first sheet and the second sheet overlap, and a processor that determines whether a sectioning command is included in a print request, and when a sectioning command is included, switches over between the first feeder and the second feeder for each print job.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

First Embodiment

Figure 1:
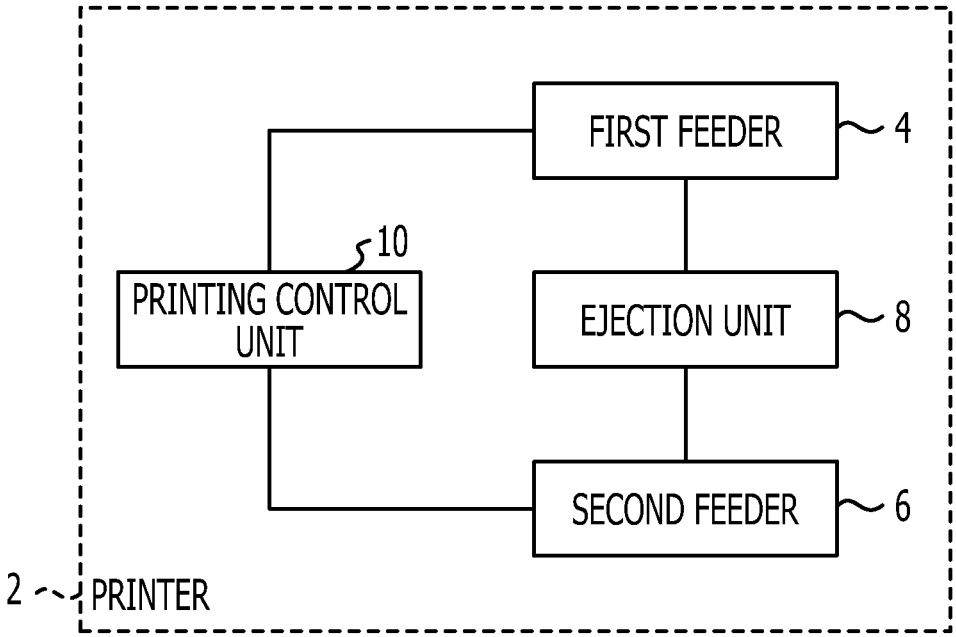
FIG. 1 illustrates an example of the structure of a printer according to a first embodiment.
Figure 2:
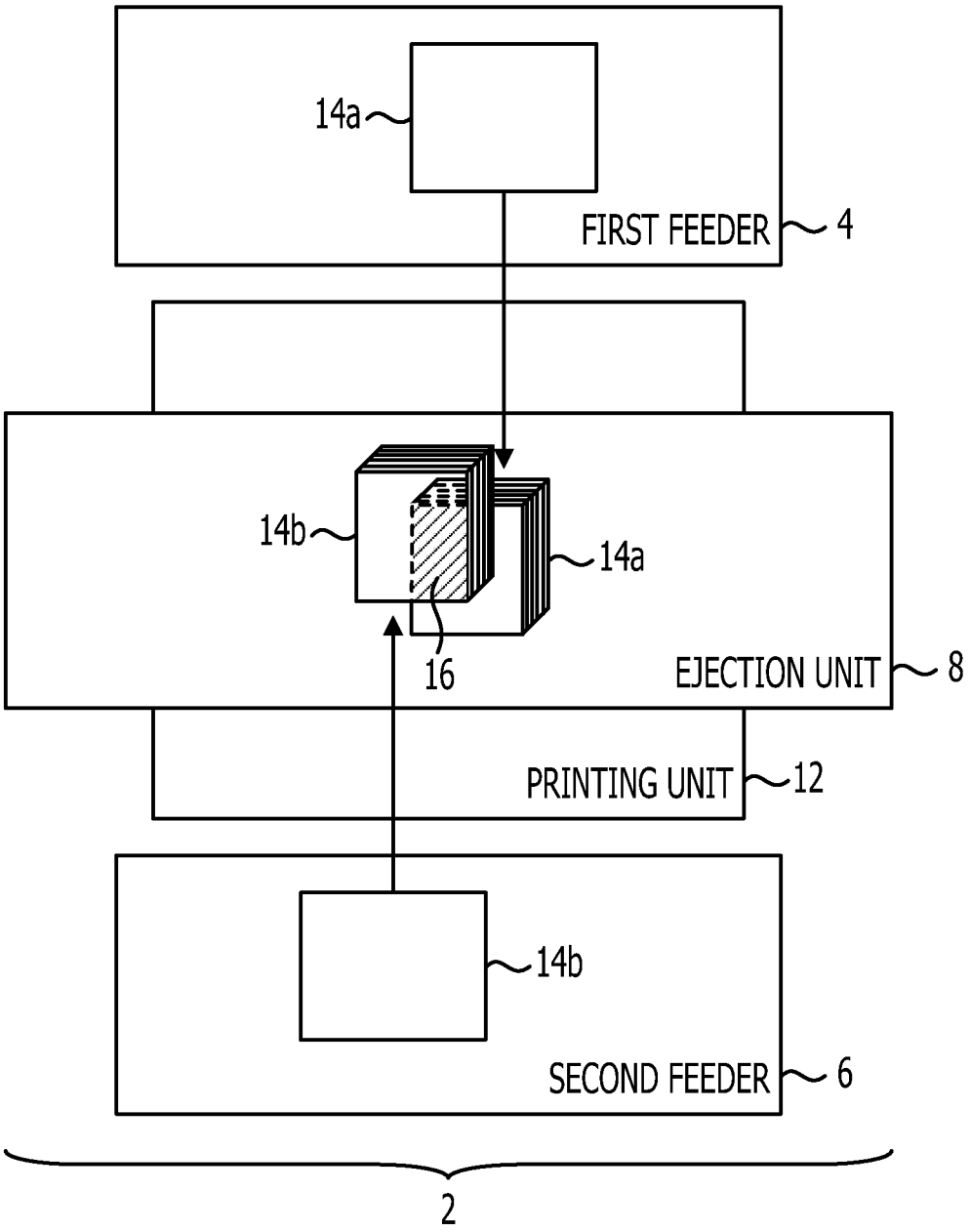
FIG. 2 illustrates an example of feed positions and ejection states of print sheets.

FIGS. 1 and 2 illustrate examples of the structure of a printer in a first embodiment. The structure in FIGS. 1 and 2 are only examples; the present disclosure is not limited to the structure.

The printer 2 in FIG. 1 is an example of the printer in the present disclosure that performs print processing on a fed print sheet and ejects the printed sheet to a given ejection position. The printer 2 is, for example, a serial printer that prints by bringing head pins (not illustrated) into contact with a print sheet. As an example, the printer 2 includes a first feeder 4, a second feeder 6, an ejection unit 8, and a printing control unit 10.

Print sheets 14*a* (see FIG. 2) are placed on the first feeder 4. The first feeder 4 supplies the print sheet 14*a* to head pins of the printer 2 in response to a print request. The first feeder 4 is placed so as to face the interior of the printer 2 from the front of the case of the printer 2, for example. The first feeder 4 may change the feed position when, for example, the position at which the print sheets 14*a* are held is adjusted.

As with the first feeder 4, the second feeder 6 supplies print sheets 14*b* (FIG. 2) toward the head pins of the printer 2. The second feeder 6 is placed so that the print sheet 14*b* may be fed in a direction opposite to the direction in which the print sheet 14*a* is fed by the first feeder 4, for example. The feed position of the second feeder 6 is set so that when the fed print sheet 14*b* is ejected to the ejection unit 8, the print sheet 14*b* overlaps the print sheet 14*a* fed from the first feeder 4.

Print sheets 14 (14*a* and 14*b*) fed by the first feeder 4 and second feeder 6 toward the head pins of the printer 2 are, for example, cut sheets of a given size. Print sheets of the same size or substantially the same size are stored in the same direction in the first feeder 4 and second feeder 6. For example, with the printer 2, when portrait print sheets of a given size are stored in the first feeder 4, portrait print sheets of a like size are stored in the second feeder 6 as well. With the printer 2, the positions of the print sheets 14 with respect to a printing unit 12 and the ejection unit 8 is determined depending on the feed positions of the first feeder 4 and second feeder 6.

When a print target is printed multiple times with the printer 2, for example, a switchover between the first feeder 4 and the second feeder 6 is made during sheet feeding each time one copy is printed. When the same page is printed multiple times, a switchover between the first feeder 4 and the second feeder 6 is made during sheet feeding each time printing for one page is completed.

The ejection unit 8 includes a stacker that collects print sheets 14 that have undergone print processing and have been ejected. Print sheets 14 fed by the first feeder 4 and second feeder 6 are placed on the ejection unit 8. Sheets printed one copy at a time or one page at a time as described above are stacked on the ejection unit 8. For example, print sheets 14*a* fed from the first feeder 4 and print sheets 14*b* fed from the second feeder 6 are ejected to the ejection unit 8 so that they partially or completely overlap.

The printing control unit 10 executes processing to separate print sheets 14. When, for example, the printing control unit 10 is notified of a print request made for the printer 2, the printing control unit 10 determines whether a sectioning command is included in the print request. When a sectioning command is included, the printing control unit 10 switches over between the first feeder 4 and the second feeder 6 for each print job during sheet feeding in response to the sectioning command. The print job includes, for example, a print command by which a print target, which includes, for example, a plurality of pages, is printed one copy at a time or one page at a time.

FIG. 2 illustrates an example of feed positions and ejection states between the first feeder 4 and the ejection unit 8 and between the second feeder 6 and the ejection unit 8.

The printing unit 12 in FIG. 2 is disposed between the first feeder 4, the second feeder 6, and the ejection unit 8. The print sheet 14*a* fed from the first feeder 4 and the print sheet 14*b* fed from the second feeder 6 are transported to the printing unit 12. The printing unit 12 performs print processing on the print sheet 14*a* and print sheet 14*b*.

The print sheets 14 are transported to the printing unit 12 according to the feed position set by the first feeder 4 or second feeder 6. The printing unit 12 performs print processing at a position corresponding to the feed position. The print sheet 14*a* and print sheet 14*b* printed by the printing unit 12 are ejected to the ejection unit 8 according to the set feed positions.

Either or both of the first feeder 4 and second feeder 6 include a mechanism that sets the feed position of the print sheet 14 placed thereon. In preparation for printing, the feed position setting mechanism sets the feed position. At the second feeder 6, the feed position may be set so that the print sheet 14*b* is fed so as to overlap the print sheet 14*a* fed from the first feeder 4 when the print sheet 14*b* is ejected.

With the printer 2, when a command for sectioning processing is received together with a command to print in copies, a print job for a first copy causes print sheets 14*a* to be fed by the first feeder 4 and a print job for a second copy causes print sheets 14*b* to be fed by the second feeder 6. That is, a switchover is performed between the first feeder 4 and second feeder 6 for each print job.

The print sheets 14*a* for one copy and the print sheets 14*b* for one copy are, for example, ejected to the ejection unit 8 so that a stacked part 16 is partially formed. The width of the stacked part 16 is determined by the feed position set on the first feeder 4 and the feed position set on the second feeder 6. By using the stacked part 16, the separation position for each print job on the ejection unit 8 may be apparent.

Figure 3:
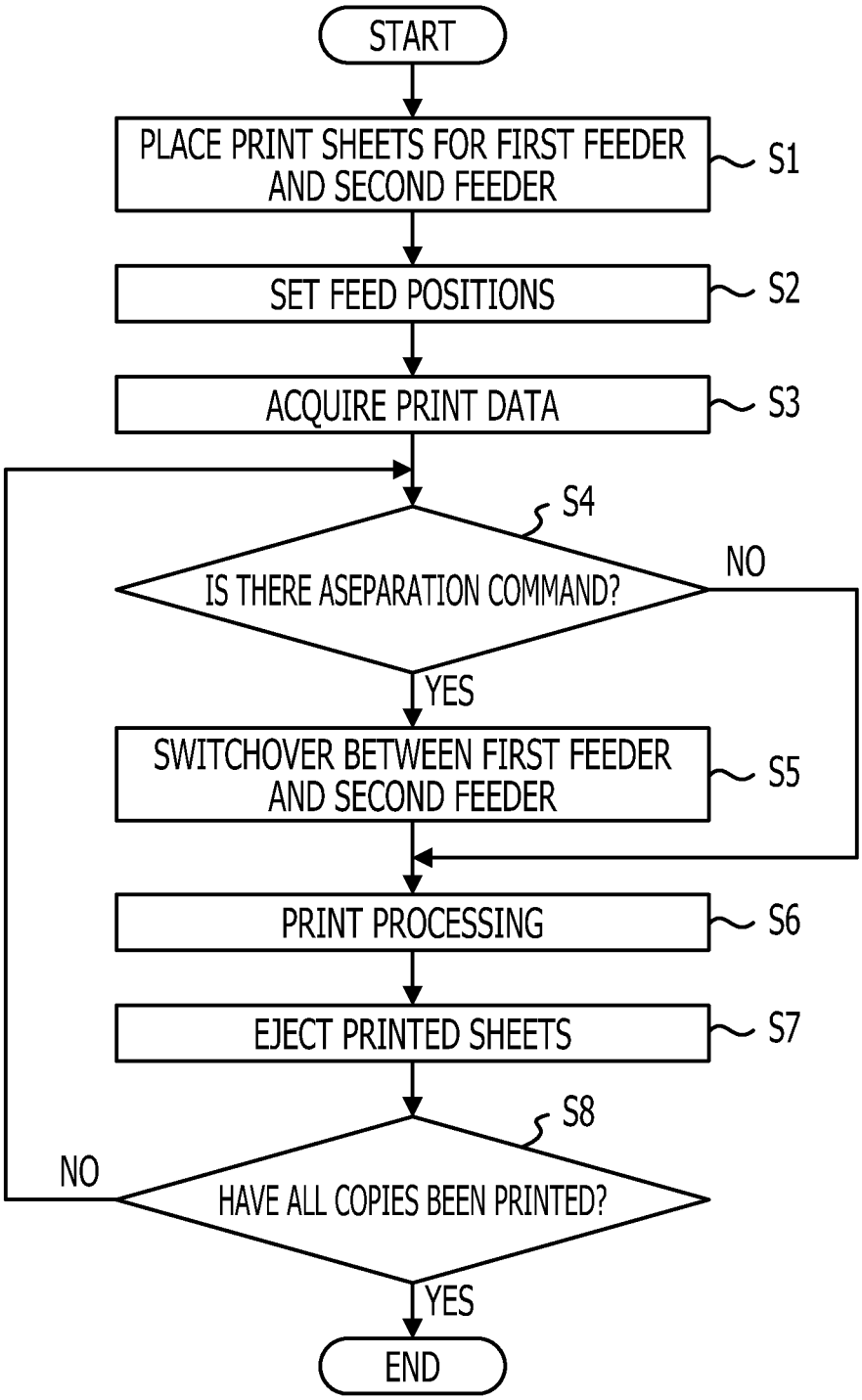
FIG. 3 is a flowchart illustrating an example of printing control.

FIG. 3 is a flowchart illustrating an example of the printing control.

The printing control is an example of a printing control program in the present disclosure. As part of the printing control, print sheets 14 are placed for the first feeder 4 and second feeder 6 (S1). Feed positions are set for the print sheets 14 placed on the first feeder 4 and second feeder 6 (S2). For example, the feed position setting mechanism disposed on either or both of the first feeder 4 and second feeder 6 sets the feed positions so that the print sheets 14*a* and print sheets 14*b* overlap on the ejection unit 8.

The printer 2 acquires print data that includes a print command from, for example, a host PC coupled to the printer 2 (S3). The printer 2 determines whether the print data includes a sectioning command (S4). When a sectioning command is included (the result in S4 is Yes), the processing proceeds to sectioned print processing in which each copy is sectioned. That is, as described above, a switchover is made between the first feeder 4 and the second feeder 6 for each print job that commands the printer 2 to print the print data one copy at a time (S5). Print processing is carried out after the first feeder 4 and second feeder 6 have been switched (S6), and the printed sheets are ejected (S7).

When a sectioning command is not included (the result in S4 is No), print sheets 14 are fed from a particular feeder (first feeder 4 or second feeder 6), printing is performed (S6), after which the printed sheets are ejected to the ejection unit 8 (S7).

The print processing is repeated until all copies indicated in the print command have been printed (as long as the result in S8 is No). After all copies have been printed as commanded (the result in S8 is Yes), the print processing is completed.

In this structure, printed sheets are shifted on the ejection unit 8 for each copy, so printed sheets may be easily sectioned. Since ejection positions are determined by the sheet position settings on the first feeder 4 and second feeder 6, print errors and an increase in printing time may be prevented without making the transport mechanism in the printer 2 complicated.

Second Embodiment

Figure 4:
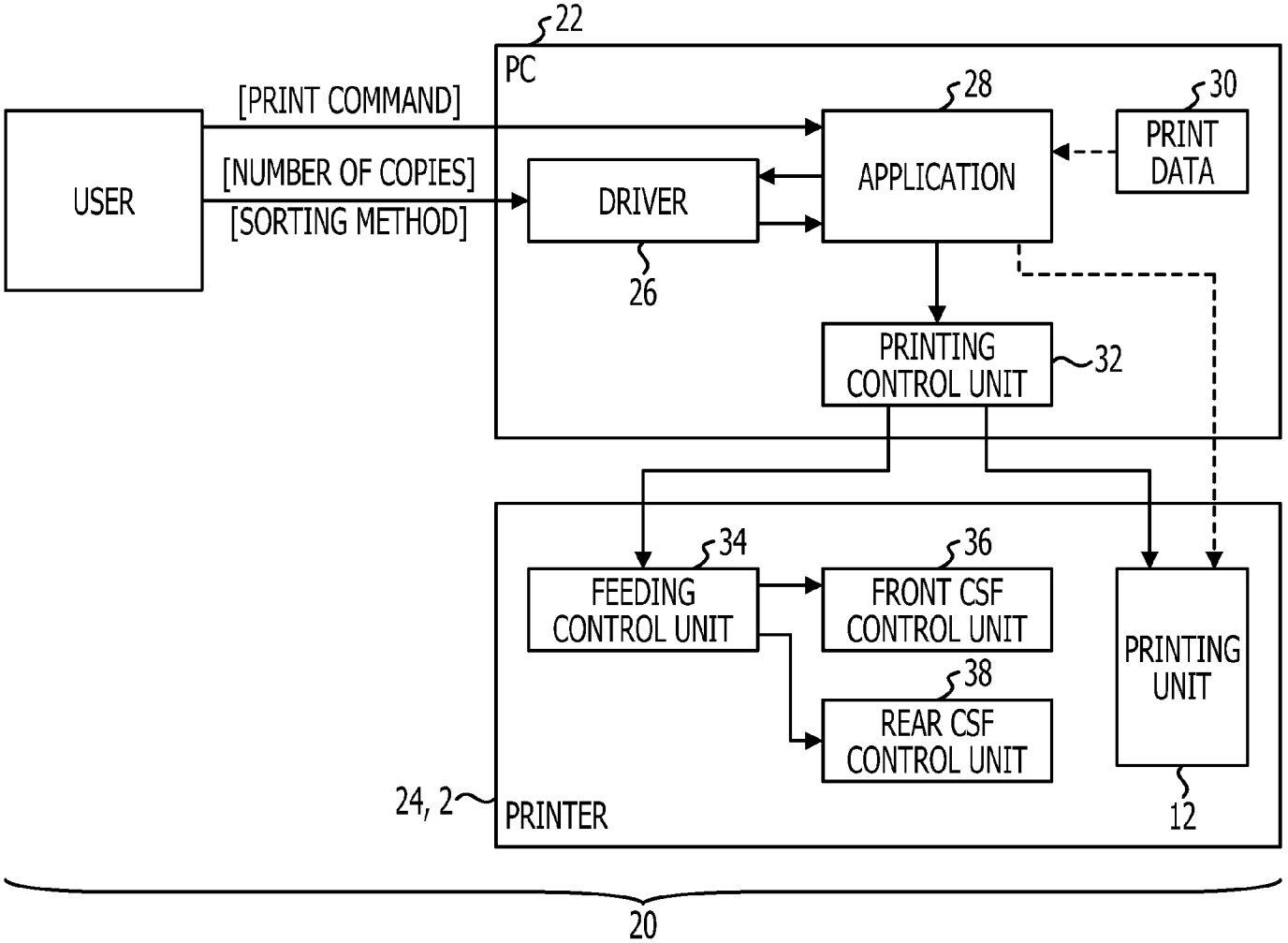
FIG. 4 illustrates an example of the structure of a printer system according to a second embodiment.
Figure 5:
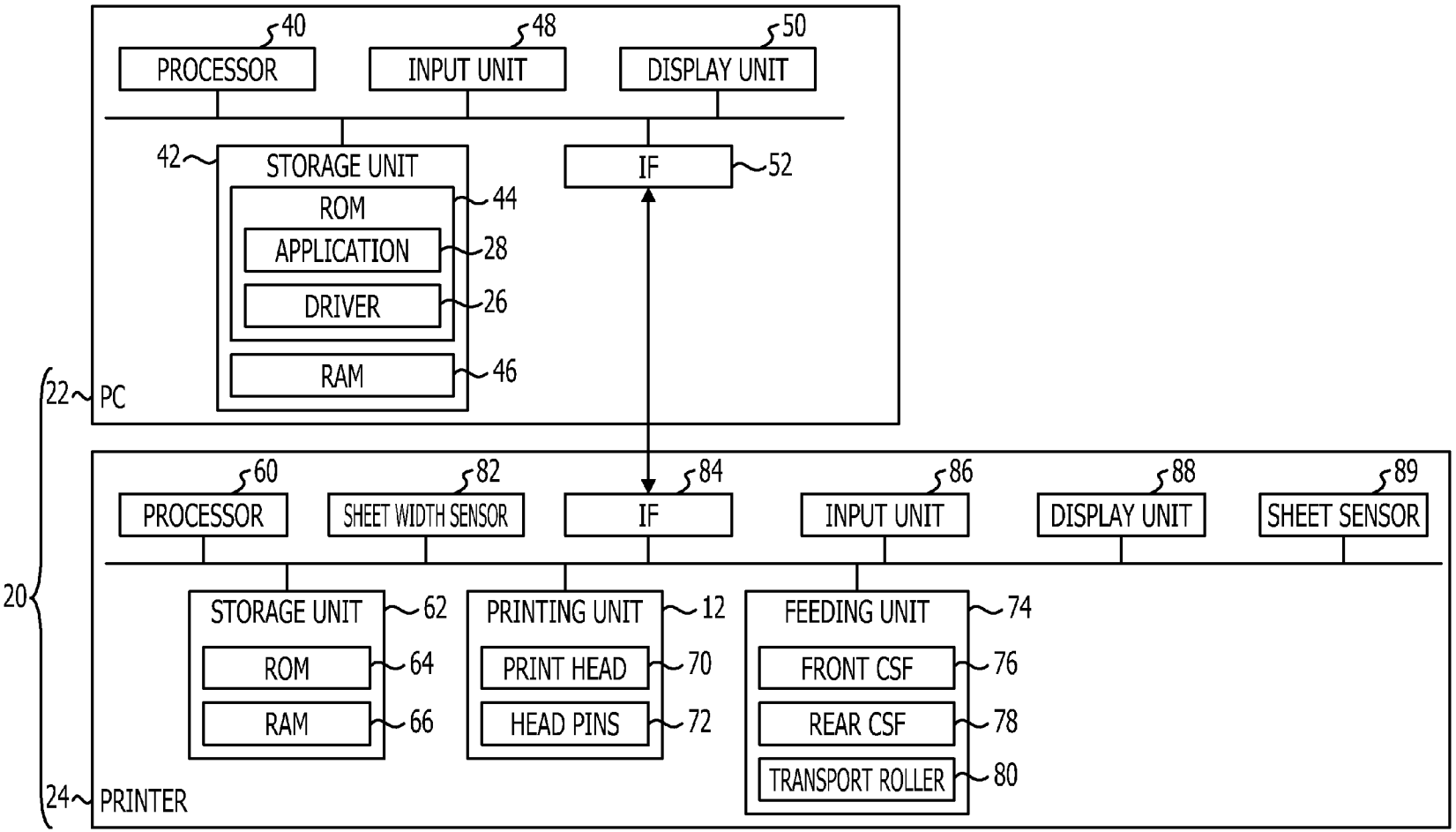
FIG. 5 illustrates examples of the hardware structures of a personal computer (PC) and a printer.

FIGS. 4 and 5 illustrate examples of the structure of a printer system in a second embodiment.

The printer system 20 in FIG. 4 includes a personal computer (PC) 22 that outputs a printing control command, print information, and the like, and also includes a printer 24 that executes printing.

The PC 22, which is coupled to the printer 24 via, for example, a wired or wireless connection, receives and transmits data such as a print command or generated print data. The PC 22 executes a driver 26 and an application 28, for example. The driver 26 is a program that controls the printer 24 and other peripheral units coupled to the PC 22. The driver 26 receives from the user information that specifies the number of copies and information that specifies a sorting method and notifies the application 28 of the information.

The application 28 is software that controls printing. When the application 28 receives a print command entered by the user into the PC 22, specified print data 30 is fetched and the print information received from the driver 26 is also fetched, after which control information to be sent to the printer 24 is generated. The print information received from the driver 26 includes information that specifies the number of copies and information that specifies a sorting method described above. The generated control information is sent from the application 28 through a printing control unit 32 to the printer 24. The print data 30 is sent to the printing unit 12 in the printer 24 by, for example, the application 28. The printing control unit 32 may be formed with, for example, the printing control program executed by the PC 22.

The printer 24 includes the printing unit 12 and a feeding control unit 34 that switches over between the first feeder 4 and second feeder 6 to separate copies. The printer 24 also includes cut sheet feeders (CSFs) that supply cut sheets or the like to the printing unit 12. To control the CSFs, the printer 24 includes a front CSF control unit 36 and a rear CSF control unit 38. Each of the front CSF control unit 36 and rear CSF control unit 38 is, for example, a mechanism that has a selected CSF transport the print sheet 14 to the printing unit 12.

The feeding control unit 34 makes up the printing control unit 10 described above. The feeding control unit 34 receives control information from the printing control unit 32 in the PC 22, according to which the feeding control unit 34 commands the sorting of print sheets 14 in the printing in copies and controls the selection of a CSF, for example. The printing unit 12 receives control information from the printing control unit 32 and also receives the print data 30 from the application 28. Thus, printing is controlled according to the command to execute printing in copies or the like.

The PC 22 in FIG. 5 includes, for example, a processor 40, a storage unit 42, an input unit 48, a display unit 50, and an interface (IF) 52.

In the processor 40, the operating system (OS) of the PC 22 and other control programs, which are prestored in the storage unit 42, are executed. The processor 40 is, for example, a central processing unit (CPU). The processor 40 functions as the printing control unit 32 when the driver 26, application 28, and other printing control programs are executed, for example.

The storage unit 42 includes, for example, a read only memory (ROM) 44 and a random access memory (RAM) 46. The ROM 44, which is implemented by, for example, a hard disk drive, a flash memory, or another storage device, prestores the OS, the application 28, and the driver 26, as well as the print data 30 and printing control information. The RAM 46 is a work area, like a DRAM, in which the control program of the PC 22 and the like are executed.

The input unit 48, which is used to manipulate the PC 22, is, for example, a keyboard or mouse. In printing control, the input unit 48 is used to enter a sectioned print command that includes a sort command, a command that specifies the number of copies, or the like, according to setting manipulation on a print setting screen.

The display unit 50 displays the print data 30 and the print setting screen. When the user manipulates the settings on the displayed print setting screen, printing control information is generated.

The display unit 50 may be a touch panel integrated with the input unit 48. In this case, touch sensors are provided on the display unit 50 to detect a contact of a finger of a user or another object or a position (coordinates) of a touch made by a touch pen such as, for example, a stylus pen (not illustrated). When a contact of a finger or another object with the touch panel is detected, the processor 40, which executes the driver 26, for example, displays an image, calculates the coordinates of the touched position, creates a pointer, moves the pointer, scrolls the screen, or carries out other control.

The interface 52, which is connected to the printer 24 via, for example, a wired or wireless connection, receives and transmits the print data 30, control information, and the like. The interface 52 is, for example, structured with a control board and a connector that is used for a wired connection to the printer 24. To make a wired connection between the printer 24 and the PC 22, a serial cable, a parallel cable, a universal serial bus (USB) cable, or a cable as per an IEEE specification may be used. Alternatively, the interface 52 may be an antenna to make a wireless connection to the printer 24 or may be, for example, an emitter to connect over infrared In addition to the printing unit 12, the printer 24 also includes a processor 60, a storage unit 62, a feeding unit 74, a sheet width sensor 82, an interface 84, an input unit 86, a display unit 88, and a sheet sensor 89.

The processor 60 executes the operation control program of the printer 24. When receiving printing control information from the PC 22, the processor 60 functions as the feeding control unit 34, front CSF control unit 36, and rear CSF control unit 38 described above and executes printing in copies, for example.

The storage unit 62 includes, for example, a ROM 64 and a RAM 66. The ROM 64 stores the operation control program of the printer 24, the print data 30 received from the PC 22, and the like. The RAM 66 is a work area used to execute the operation control program of the printer 24 and other programs.

The storage unit 42 is not limed to the ROM 44, and the storage unit 62 is not limited to the ROM 64; the storage unit 42 and storage unit 62 may, for example, be an electrically erasable and programmable read only memory (EEPROM).

The application 28, driver 26, and other programs are not limited to programs prestored in the ROM 44; for example, they may be programs prestored on a magnetic disk, a floppy disk, an optical disk, or another computer-readable storage medium. It is also possible to read the application 28, driver 26, and other programs from a server, a database, or the like that is on a network.

The printing unit 12 is structured with a print head 70 and head pins 72, which are used to configure a serial printer. The print head 70 includes a plurality of head pins 72. When the print head 70 moves in a primary scanning direction with respect to the print sheet 14 during print processing, the head pins 72 move to the print position. The head pins 72 are an example of a printing mechanism. The head pins 72 protrude from the print head 70 toward the print sheet 14, and their ends come into contact with the print sheet 14 according to the shape of a character, a symbol, or the like in the print target. When a given pressure is applied to the head pins 72, printing is performed.

The feeding unit 74 consecutively feeds the print sheets 14 placed on it to the printing unit 12 of the printer 24. The feeding unit 74 is structured with, for example, a front CSF 76, a rear CSF 78, and transport rollers 80.

The front CSF 76 is an example of the first feeder 4 described above, for example. The front CSF 76 is placed on the front side of the printer 24 and feeds the print sheet 14*a* to the printing unit 12. The front CSF 76 has a sheet adjusting mechanism that adjusts the feed position of the print sheet 14*a*, for example.

The rear CSF 78 is an example of the second feeder 6 described above. The front CSF 76 is placed on the rear side of the printer 24 and feeds the print sheet 14*b* to the printing unit 12. The feed position on the rear CSF 78 is set so that the print sheet 14*b* ejected from the rear CSF 78 overlaps the print sheet 14*a* fed from the front CSF 76.

The transport roller 80 is a mechanism that transports the print sheet 14 in a secondary scanning direction. A plurality of transport rollers 80 are provided, for example, near the feed positions on the front CSF 76 and rear CSF 78, the printing unit 12, and the stacker to which the print sheet 14 that have undergone printing is ejected. The transport roller 80 is rotated or stopped by controlling a roller driver (not illustrated) such as a motor in response to a control command from the front CSF control unit 36 or rear CSF control unit 38 described above.

The sheet width sensor 82 detects either or both of the positions of the right and left edges of the print sheet 14 placed on the printer 24. The sheet width sensor 82 which is, for example, a color identification sensor, is placed on the print head 70 or a peripheral part thereof and moves in the primary scanning direction. The sheet width sensor 82 detects an edge of the print sheet 14 by, for example, detecting a point of a change between the while color of the print sheet 14 and the black color of a platen roller on which the print sheet 14 is placed. Alternatively, the sheet width sensor 82 may be a reflection-type sensor that detects the presence or absence of a sheet with reflected light.

The interface 84 is for coupling to the PC 22. The interface 84 is structured so as to establish a wired connector or wireless connection, as described above.

The input unit 86 is an example of an input unit that supplies settings to the printer 24.

The display unit 88 information such as displays the setting screen of the printer 24 and a print state.

The sheet sensor 89 monitors the presence or absence of the placed print sheet 14, an amount by which the print sheet 14 is drawn, the position of the placed print sheet 14, the lower edge of the print sheet 14, or the like. The sheet sensor 89 may use reflected light from a reflection-type sensor, for example.

Figure 6:
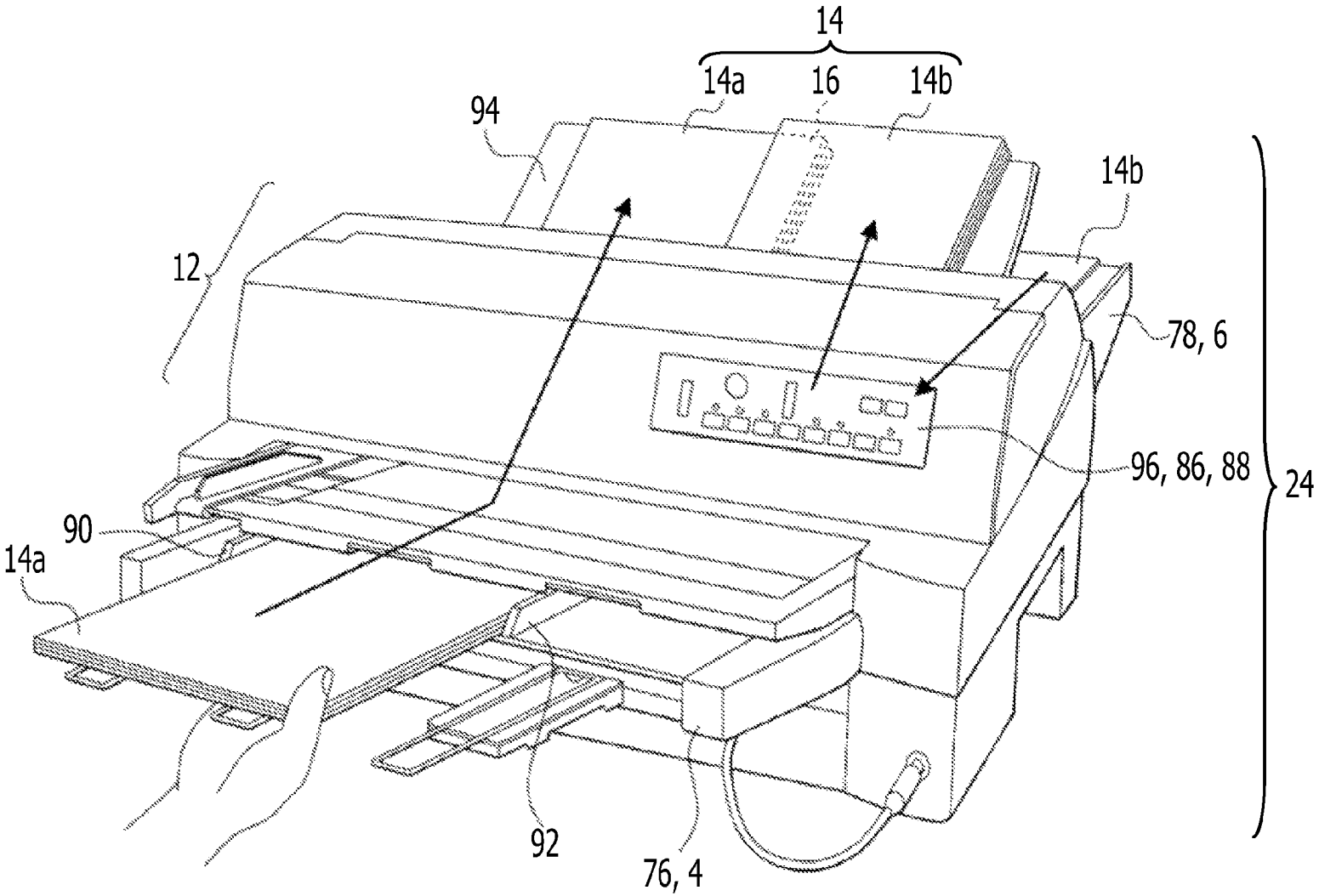
FIG. 6 is a perspective view illustrating an example of the structure of the printer.
Figure 7:
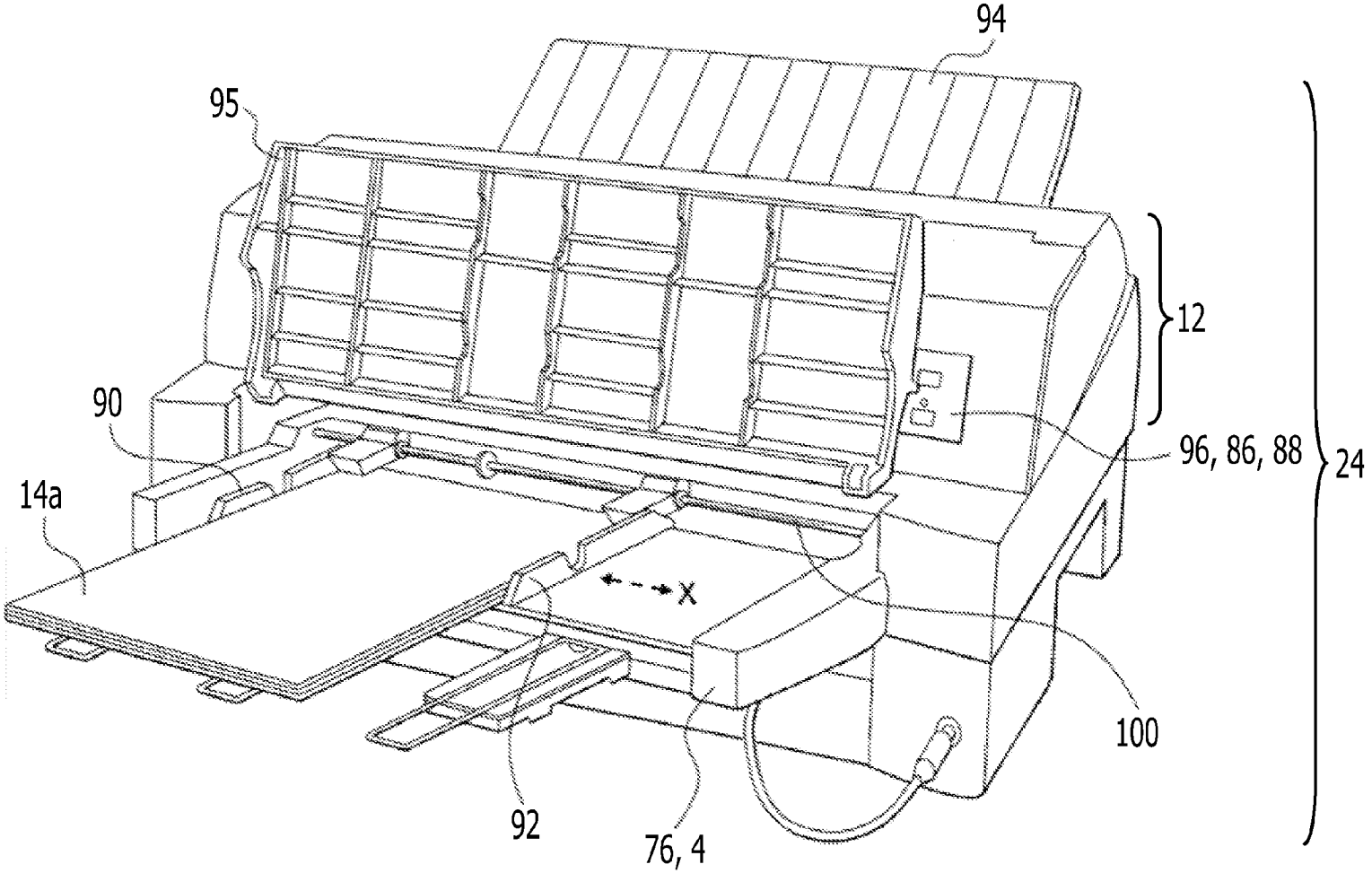
FIG. 7 illustrates an example of a state in which a front cut sheet feeder (CSF) is attached to the printer.
Figure 8:
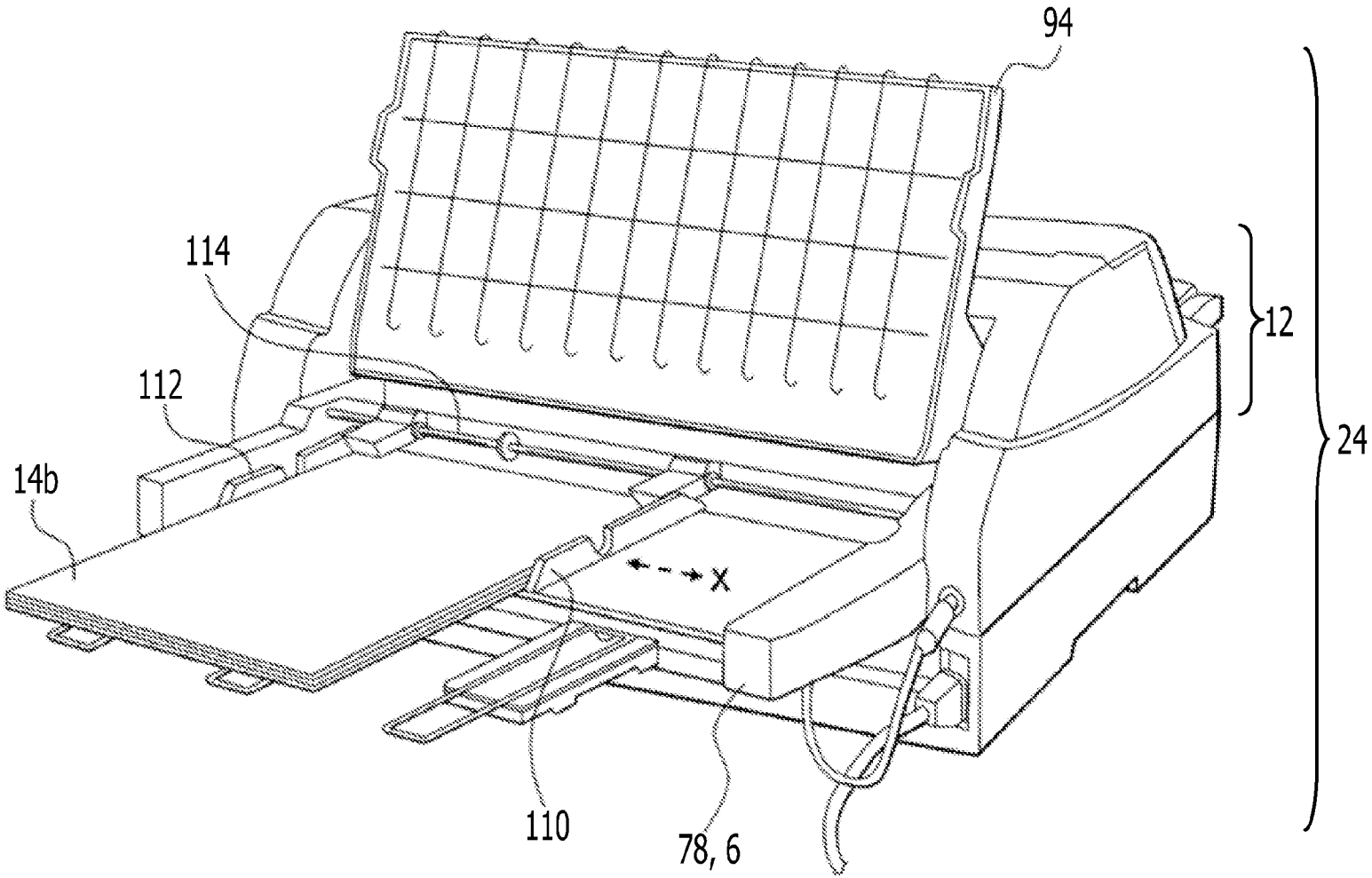
FIG. 8 illustrates an example of a state in which a rear CSF is attached to the printer.

FIGS. 6, 7, and 8 illustrate examples of the outside shape of the printer 24.

The printer 24 in FIG. 6 has the front CSF 76 on the front side. For example, print sheets 14*a* in the form of cut sheets of a given size are placed in a given orientation on the front CSF 76 by the user before printing is executed or at the start of print processing. The front CSF 76 has guides 90 and 92 that guide, for example, the right and left edges of the print sheet 14*a*. With the printer 24, the placed print sheet 14*a* is brought into the interior, printing is carried out on the print sheet 14*a*, and the print sheet 14*a* is ejected to a stacker 94 on the rear side. The ejection position on the stacker 94 is determined according to the position of the print sheet 14*a* set on the front CSF 76.

An operation panel 96 is provided on the front surface of the printer 24. The operation panel 96 has a display unit 88 that indicates setting information of the printer 24 and a print state by, for example, displaying characters and turning on lamps, and also has an input unit 86, which has operation buttons used to manipulate the printer 24.

On the rear side of the printer 24, the rear CSF 78 is disposed, for example, at the lower portion of the rear side. The stacker 94, which holds the printed and ejected print sheet 14, is disposed above the rear CSF 78. The rear CSF 78 has substantially the same structure as the front CSF 76; the rear CSF 78 feeds the print sheet 14*b* from the rear side of the printer 24 to the interior thereof. As with the front CSF 76, the rear CSF 78 has guides 110 and 112 (see FIG. 8) that set a feed position. The ejection position of the print sheet 14*b* is determined according to the feed position.

With the printer 24, the print sheet 14*a* fed from the front CSF 76 and the print sheet 14*b* fed from the rear CSF 78 are of the same size and are oriented in the same direction, for example.

The printer 24 ejects the print sheet 14*a* fed from the front CSF 76 and the print sheet 14*b* fed from the rear CSF 78 so that they partially or completely overlap on the stacker 94. When the print sheet 14*a* and print sheet 14*b* partially overlap on the stacker 94, for example, the print sheet 14*a* and print sheet 14*b* are stacked with a shift to the right or left. When a print target is printed consecutively with the printing in copies, the feed positions on the front CSF 76 and rear CSF 78 are used to feed the print sheet 14*a* and print sheet 14*b* by making a switchover between the front CSF 76 and the rear CSF 78 for each copy as described above. When a plurality of sheets of the same page are printed, the print sheet 14*a* and print sheet 14*b* are fed by making a switchover between the front CSF 76 and the rear CSF 78 each time one page is printed.

The front CSF 76 is attached to the printer 24 as illustrated in FIG. 7. During the attachment of the front CSF 76, a tray 95 provided on the front surface is opened upward and the front CSF 76 is inserted with the front end thereof facing the interior of the printer 24, for example. The print sheet 14*a* is placed on the front CSF 76 between the guides 90 and 92. The guides 90 and 92 of the front CSF 76 function as a sheet adjustment mechanism for the print sheet 14*a*; the distance between the guides 90 and 92 may be set according to the size of the print sheet 14*a*. The guides 90 and 92 are disposed so as to be movable in parallel to the right and left on the front CSF 76 along a guide axis 100. In this case, the guides 90 and 92 may move synchronously in parallel in the X direction while the distance set between them is held, for example.

The rear CSF 78 is attached to the rear of the printer 24 as illustrated in FIG. 8. During the attachment of the rear CSF 78, the stacker 94 is opened upward and the rear CSF 78 is inserted with the front end thereof facing the interior of the printer 24, for example. The guides 110 and 112 of the rear CSF 78 function as a sheet adjustment mechanism for the print sheet 14*b*; they are set so as to movable in parallel in the X direction along a guide axis 114, as with the guides 90 and 92 of the front CSF 76.

Figure 9:
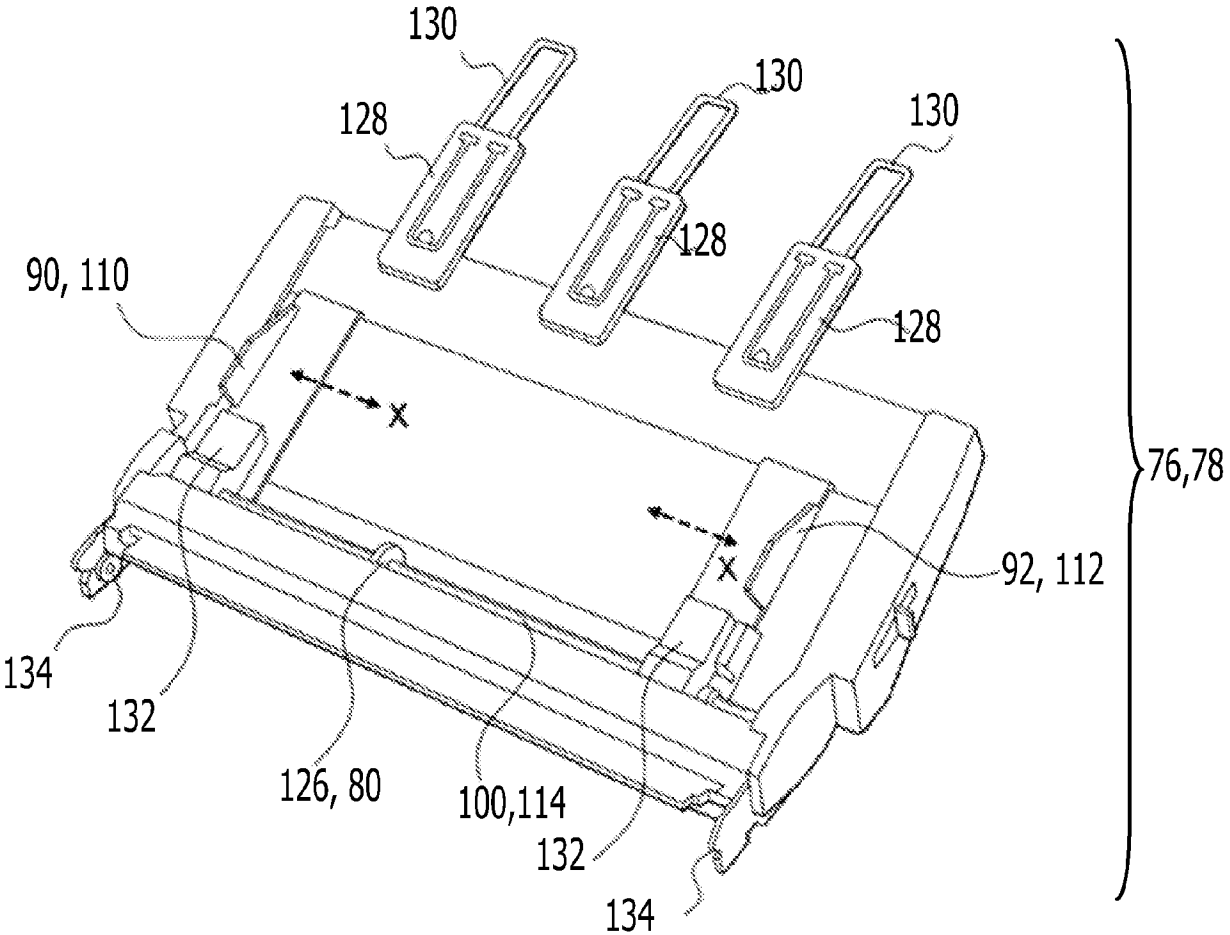
FIG. 9 illustrates an example of the outside shape of the front CSF and rear CSF.

The front CSF 76 and rear CSF 78 in FIG. 9 are each an automatic feeding unit that consecutively feeds print sheets 14, which are cut sheets, to the interior of the printer 24 one at a time. The front CSF 76 and rear CSF 78, for example, each have extension guides 128 and extension wires 130 at the back to suppress the back edge of the print sheet 14 from warping. Each of the guides 90, 92, 110, and 112, which may be able to set a feed position for the print sheet 14, has a feed roller 132, for example, near a feed slot to feed one print sheet 14 at a time while preventing the print sheet 14 from lifting. The guide axis 100 has a feed roller 126 to pick up the print sheet 14*a* on the uppermost surface of the front CSF 76. The guide axis 114 has another feed roller 126 to pick up the print sheet 14*b* on the uppermost surface of the rear CSF 78.

Engaging fasteners 134 are formed at the front end of the front CSF 76 and rear CSF 78. The engaging fasteners 134 are inserted into the printer 24 and engage the case of the printer 24.

Figure 10:
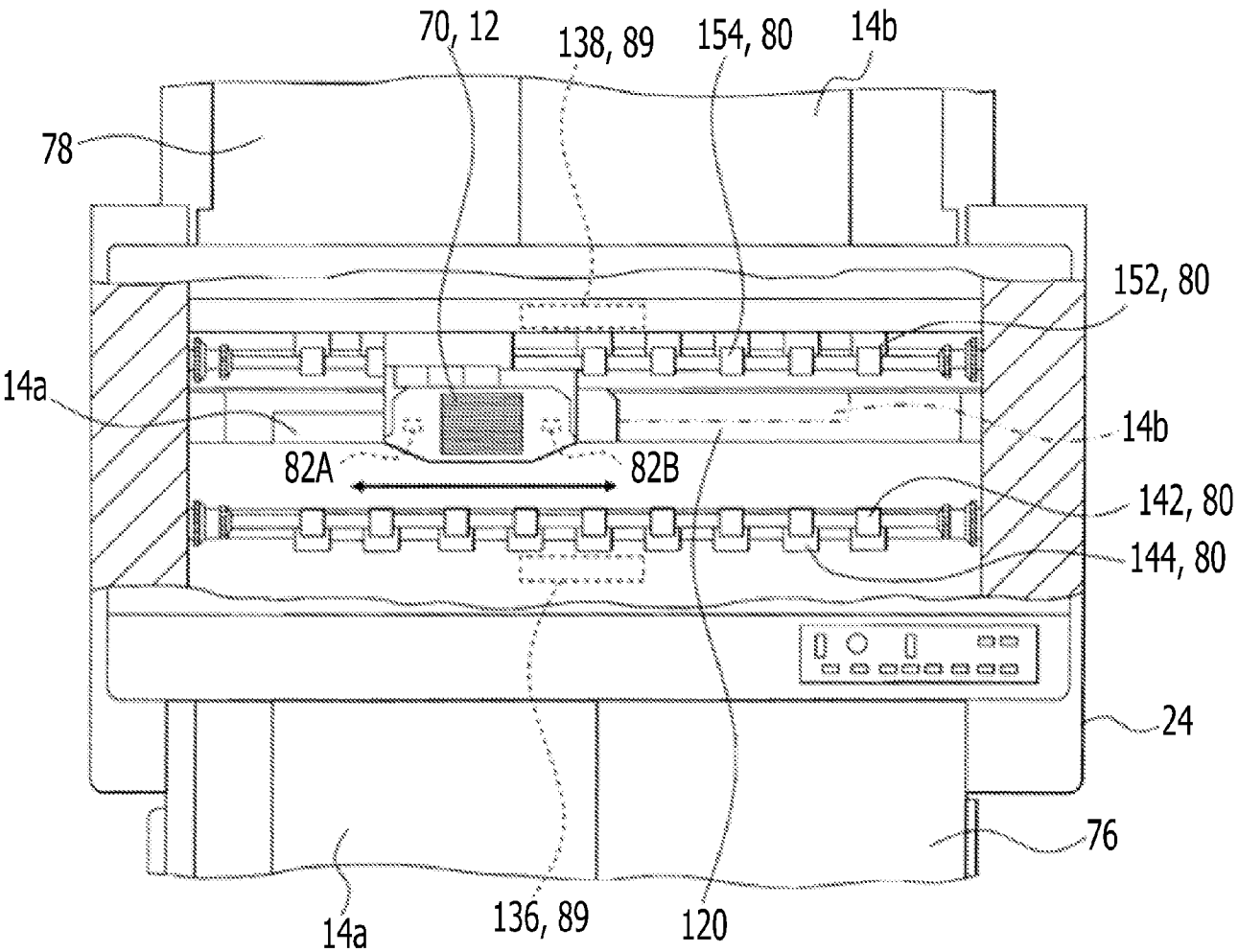
FIG. 10 illustrates an example of the structure of a printing unit and a sheet feed state.

FIG. 10 illustrates an example of the structure of the printing unit 12 and an example of a state of a sheet fed to the printing unit 12. The structure illustrated in FIG. 10 is only an example; the present disclosure is not limited to this structure.

In addition to the print head 70, the printer 24 internally has a platen roller 120, transport rollers 142, 144, 152, and 154, and other parts. The print head 70 moves inside the printer 24 in the primary scanning direction along, for example, a guide bar (not illustrated) so as to be positioned on the print position on the print sheet 14.

When the print sheet 14 is placed on platen roller 120, the print surface of the print sheet 14 is made parallel to the print head 70. Since the platen roller 120 rotates at the time of printing, the print sheet 14 is transported in the secondary-scanning direction and the print position of the print head 70 moves to the next line. The platen roller 120 is made of a resin, a metal, or the like, whose the color is such that the boundary between the platen roller 120 and the placed print sheet 14 is identifiable.

The print sheet 14*a* fed from the front CSF 76 is transported by the transport rollers 142 and 144 toward the print head 70. The print sheet 14*b* fed from the rear CSF 78 is transported by the transport rollers 152 and 154 toward the print head 70. The transport rollers 142, 144, 152, and 154 are structured so as to be movable vertically, for example, so they are selectively brought into contact with the print sheet 14 and separated from the print sheet 14.

In addition, the printer 24 internally has either, both, a plurality of transport rollers 146 and 148 (see FIG. 11) that transport the print sheet 14 on which printing has been carried out to the stacker 94 (see FIG. 6). In the printer 24, sheet sensors 136 and 138 are provided along the transport path of the print sheet 14. The sheet sensor 136 detects the front edge of the transported print sheet 14*a*, for example. The sheet sensor 138 detects the front edge or rear edge of the transported print sheet 14*b*, for example.

The print head 70 has sheet width sensors 82A and 82B, which detect edges of the transported print sheet 14, for example, at the right and left edges. A print start position on the print sheet 14*a* is determined from a detection result obtained from the sheet width sensor 82A. A print end position is determined from a detection result obtained from the sheet width sensor 82B. For the print sheet 14*b*, which is fed in a direction opposite to the direction in which the print sheet 14*a* is fed, a print end position is determined from a detection result obtained from the sheet width sensor 82A and a print start position is determined from a detection result obtained from the sheet width sensor 82B.

The sheet width sensors 82A and 82B are not limited to a case in which both of them are disposed at the right and left of the print head 70; for example, a single sheet width sensor 82 may be attached to the print head 70 or a peripheral part thereof. It suffices for the sheet width sensor 82 to detect an edge of the print sheet 14*a* and print sheet 14*b*.

The feed position is, for example, set so that part of the right side of the print sheet 14*a* placed on the front CSF 76 linearly overlaps part of the left side of the print sheet 14*b* placed on the rear CSF 78 in a roughly parallel fashion. When the print sheet 14 is drawn, for example, the feeding control unit 34 may confirm the feed position according to the presence or absence of the print sheet 14 and the right and left edges of the print sheet 14*a* and print sheet 14*b*, which are detected by the sheet width sensor 82.

Figure 11:
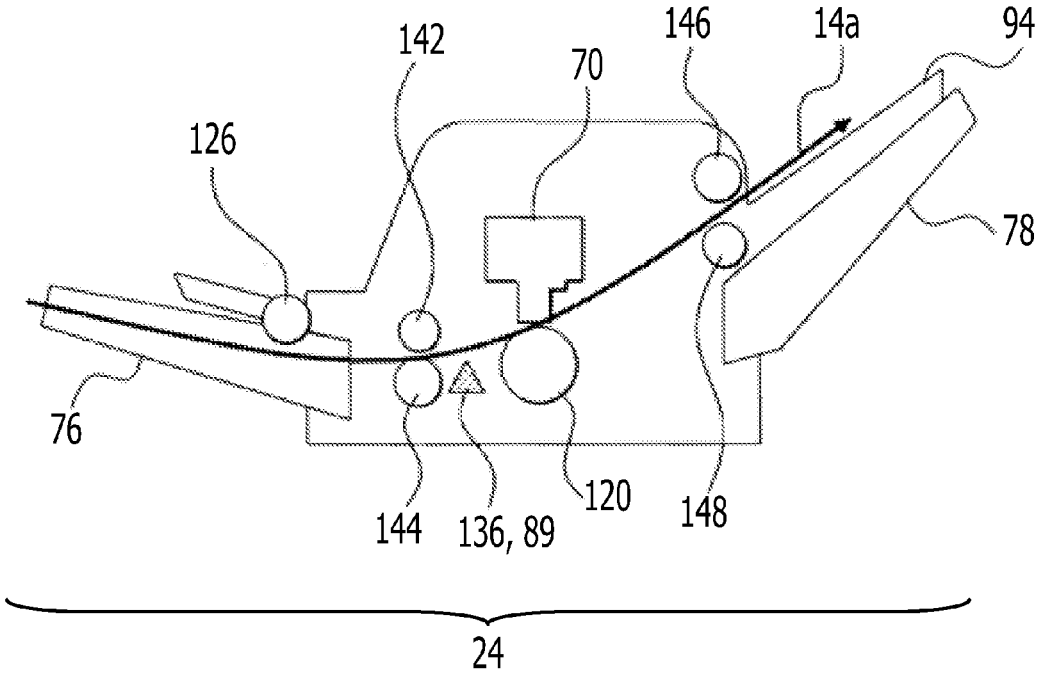
FIG. 11 illustrates an example of sheet feeding and ejection with the front CSF.
Figure 12:
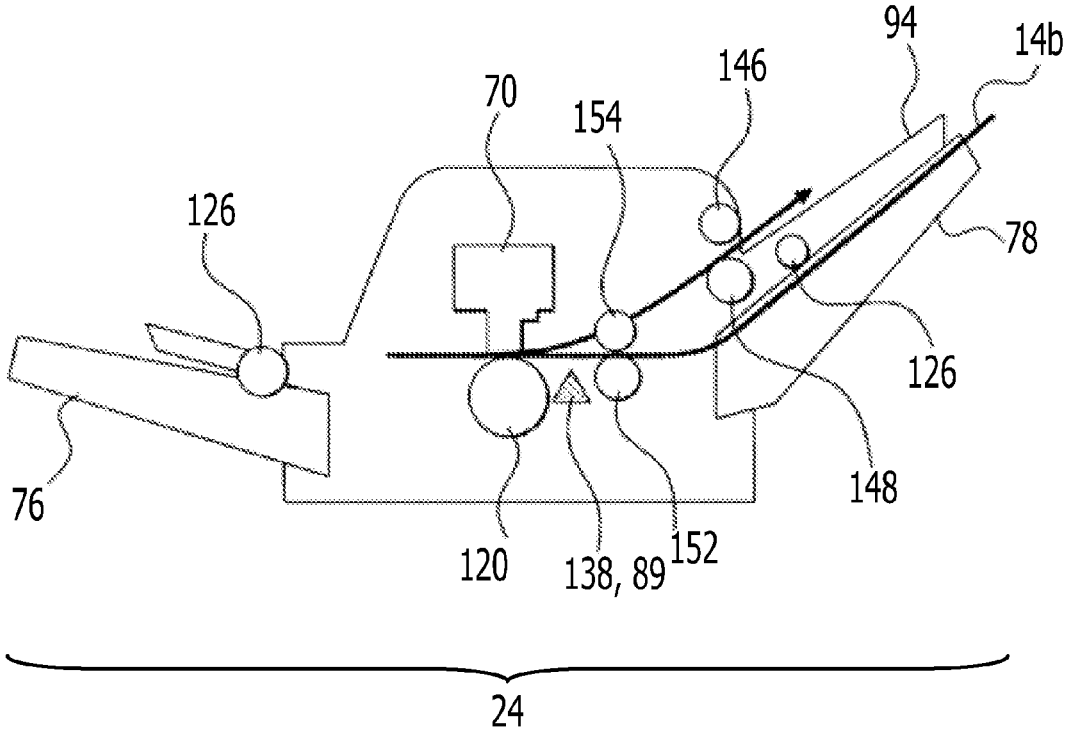
FIG. 12 illustrates an example of sheet feeding and ejection with the rear CSF.

FIGS. 11 and 12 illustrate examples of the state of print sheet feed and ejection inside the printer 24.

The selected front CSF 76 or rear CSF 78 feeds paper according to a command to start print processing. The printer 24 receives a print start command, print data, a feeder command, and the like from, for example, the PC 22. When print sheets 14*a* are fed from the front CSF 76 illustrated in FIG. 11, the topmost print sheet 14*a* is picked up by, for example, the feed roller 126. At the start of feeding, the transport rollers 142 and 144 are disposed so as to be open in the vertical direction and not in contact with the fed print sheet 14*a* (in a free state). Alternatively, the transport rollers 142 and 144 are maintained in a state in which the rotation of a driving motor is stopped so as not to transport the print sheet 14*a*.

The transport rollers 142 and 144 are disposed at a position at which transport rollers 142 and 144 and which the print sheet 14*a* when, for example, the sheet sensor 136 detects the front edge of the fed print sheet 14*a*. After sandwiching the print sheet 14*a*, the transport rollers 142 and 144 start to rotate. When the sheet sensor 136 detects the print sheet 14*a*, the feed roller 126 of the front CSF 76 stops rotating.

The print sheet 14*a* is transported toward the print head 70 by the rotation of the transport rollers 142 and 144. The print sheet 14*a* is then placed on the platen roller 120 and undergoes print processing by the print head 70, after which the print sheet 14*a* is sandwiched by the transport rollers 146 and 148, is transported to the stacker 94, and is ejected from the printer 24.

The printer 24 in FIG. 12 switches to feeding from the rear CSF 78 in response to either a print start command from the PC 22 or under control by which the printing of a next copy is started. When feeding print sheets 14*b* from the rear CSF 78, the topmost print sheet 14*b* is picked up by, for example, the feed roller 126. At this point, the transport rollers 152 and 154 are maintained in a free state. When the sheet sensor 138 detects the front edge of the print sheet 14*b*, the transport rollers 152 and 154 sandwich the print sheet 14*b* and start to rotate.

The print sheet 14*b* transported by the transport rollers 152 and 154 is fed to the rear side of the print head 70. The print head 70 carries out printing one character at a time on the print sheet 14*b* fed from the rear side from left to right with respect to the transport direction, for example.

After printing on one fed print sheet 14*b* has been completed, and when the sheet sensor 138 detects the rear edge of the print sheet 14*b* or a state in which the print sheet 14 is not detected is entered, the printer 24 proceeds to processing to eject the print sheet 14*b* to the stacker 94. At this point, the transport rollers 146 and 148 start to rotate. As part of the ejection processing, the transport roller 154 is lowered, for example, so as to remove the clearance between the transport roller 154 and the transport roller 152. As a result, the print sheet 14*b* may be prevented from moving toward the rear CSF 78.

The platen roller 120 rotates in the direction opposite to the rotational direction in the print processing, transporting the print sheet 14*b* on the platen roller 120 toward the transport roller 154. The print sheet 14*b* on which printing has been carried out comes into contact with, for example, the transport roller 154 and is then transported toward the transport rollers 146 and 148. The print sheet 14*b* is then ejected to the stacker 94 by the rotation of the transport rollers 146 and 148.

Figure 13:
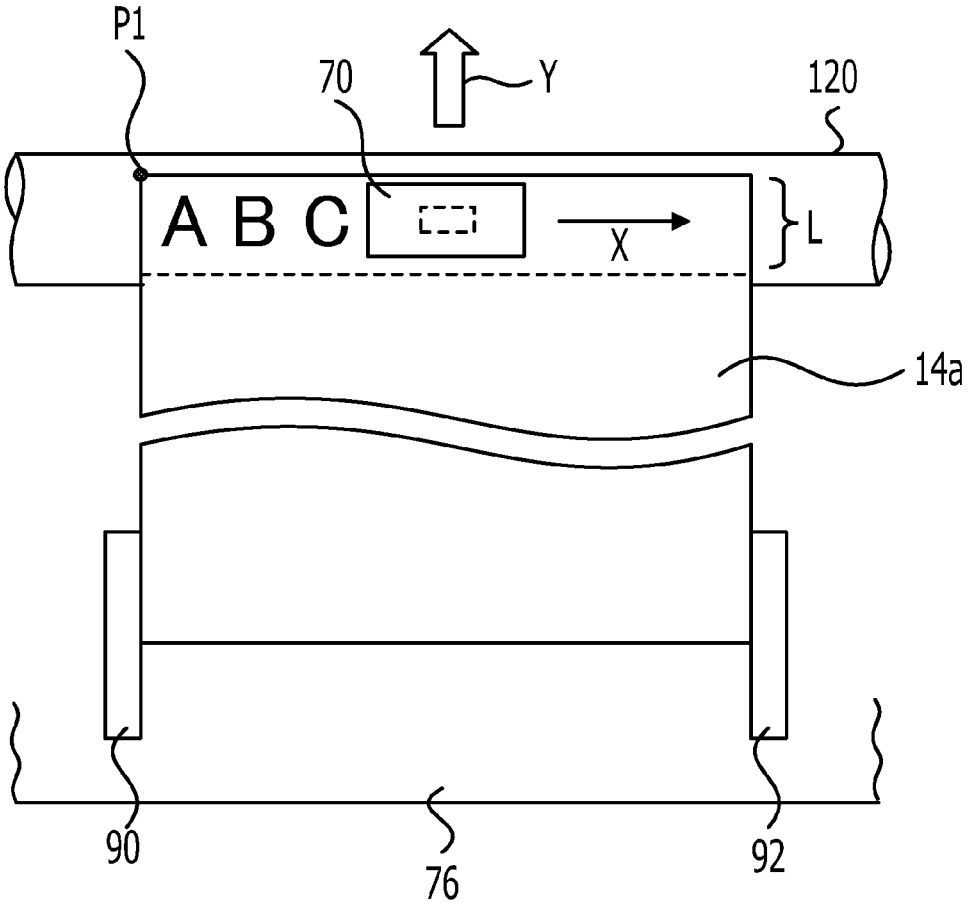
FIG. 13 illustrates an example of print processing when sheets are fed from the front CSF.
Figure 14:
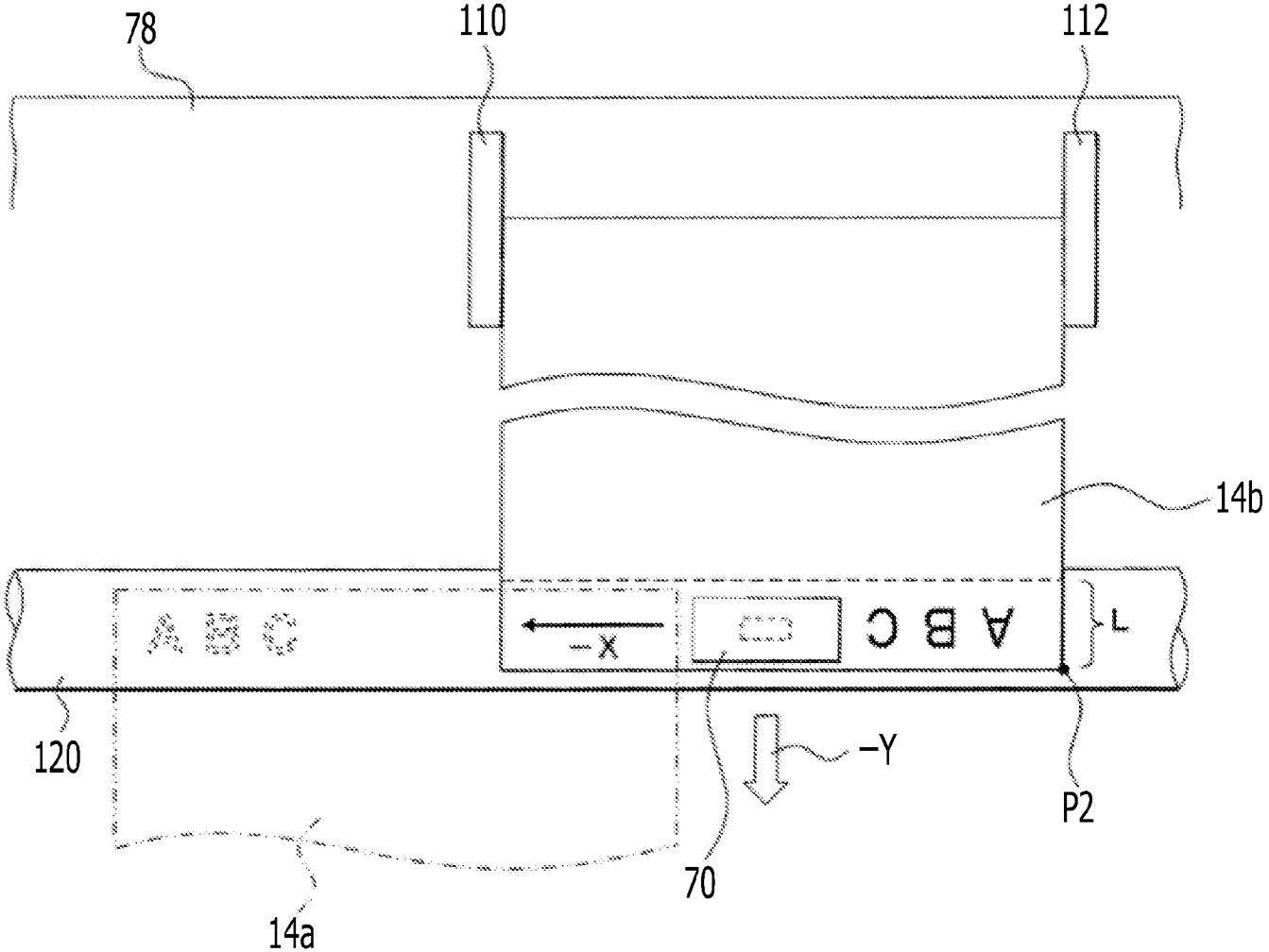
FIG. 14 illustrates an example of print processing when sheets are fed from the rear CSF.
Figure 15:
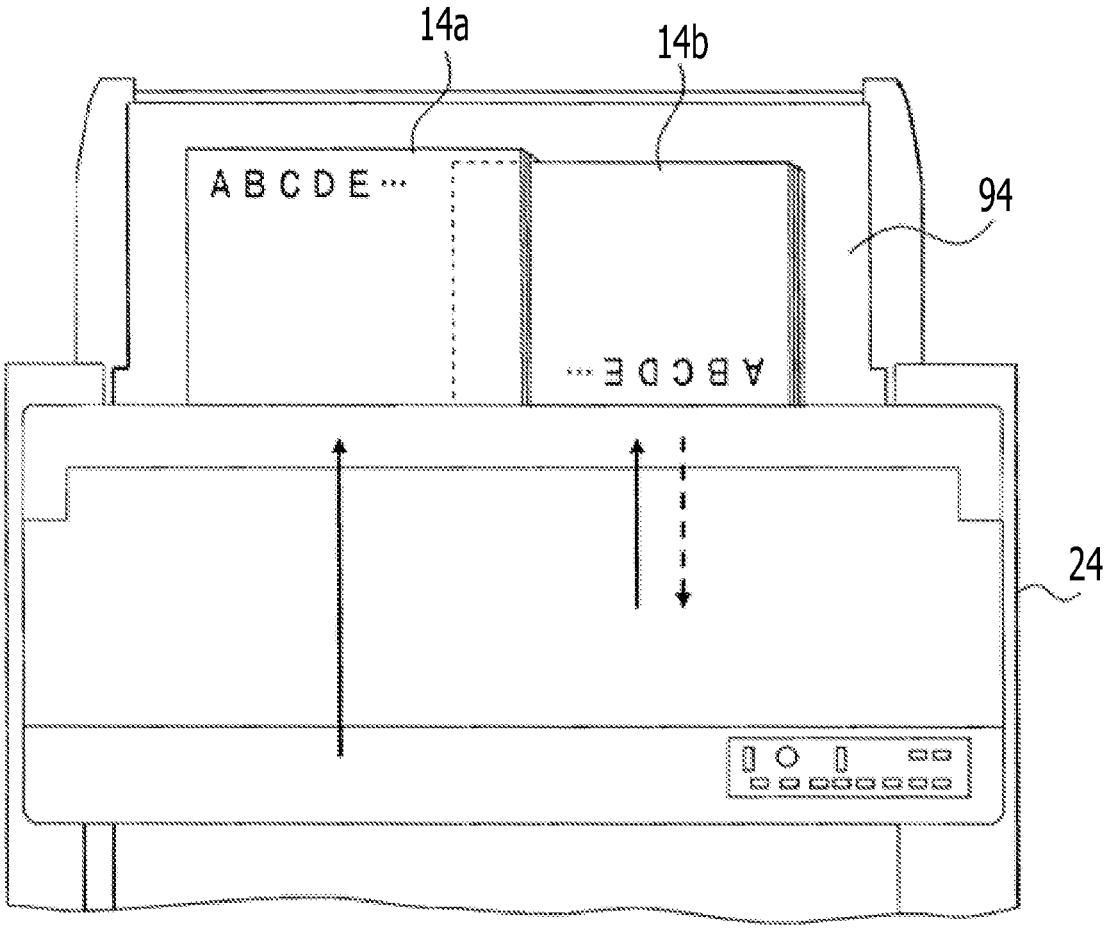
FIG. 15 illustrates an example of the state of ejected sheets.

FIGS. 13 to 15 illustrate examples of print processing. The structures in FIGS. 13 to 15 are only examples; the present disclosure is not limited to these structures.

The print head 70 in FIG. 13 is carrying out print processing for the print sheet 14*a* fed from the front CSF 76. In this print processing, the printer 24 detects a reference position P1 of the print sheet 14*a* by using, for example, the sheet width sensor 82A of the print head 70. The feeding control unit 34 of the printer 24 carries out position control based on the reference position P1 of the print sheet 14*a*.

The platen roller 120 rotates by a given amount and transports the print sheet 14*a* in the secondary-scanning direction (Y-axis direction) so that the print head 70 is placed within a print range L of one line of the print sheet 14*a*, for example, as illustrated in FIG. 13. The print range L is, for example, an area in which one line of printing is carried out; the print range L may be changeable by, for example, entering a line space setting. In this printing unit 12, the print head 70 prints characters one at a time while moving in the primary scanning direction indicated by the X axis, that is, from the left edge of the print sheet 14*a* placed on the platen roller 120 toward the right edge.

The print head 70 in FIG. 14 prints on the print sheet 14*b* fed from the rear CSF 78. The sheet width sensor 82B (FIG. 10) detects a reference position P2 of the fed print sheet 14*b*, for example. The rotation of the platen roller 120 is controlled to place the print sheet 14*b* so that the print head 70 is placed within the print range L as described above.

The printer 24 prints on the print sheet 14*b* fed from the rear CSF 78 from the right edge toward the left edge, that is, in the negative X direction. That is, with the printer 24, the print start position and primary scanning direction are changed in accordance with the direction in which the print sheet 14 is fed to the print head 70.

With the printer 24, characters printed according to the feed direction may also be rotated. The print head 70 in FIG. 14 rotates characters to be printed through, for example, 180 degrees with respect to the direction in which printing is performed on the print sheet 14*a*. Thus, the printer 24 prints on the print sheet 14 transported toward the print head 70 in the sequence of the print target of the print data 30. When, for example, the print data 30 is stored in the order of A, B, C, . . . , the print head 70 rotates characters and changes the primary scanning direction for printing on the print sheet 14*b*. Thus, characters are printed on the print sheet 14*b* in the order of A, B, C, . . . , according to the sequence of the characters included in the received print data 30.

The print sheets 14*a* and print sheets 14*b* ejected on the stacker 94 in FIG. 15 partially or completely overlap, and the characters on the printed surfaces of the print sheets 14*b* have been rotated through, for example, 180 degrees. Since the transport direction of the print sheet 14 remains unchanged in the printer 24, the orientation of the characters at the time of ejection is determined by the print direction of the print head 70.

Figure 16:
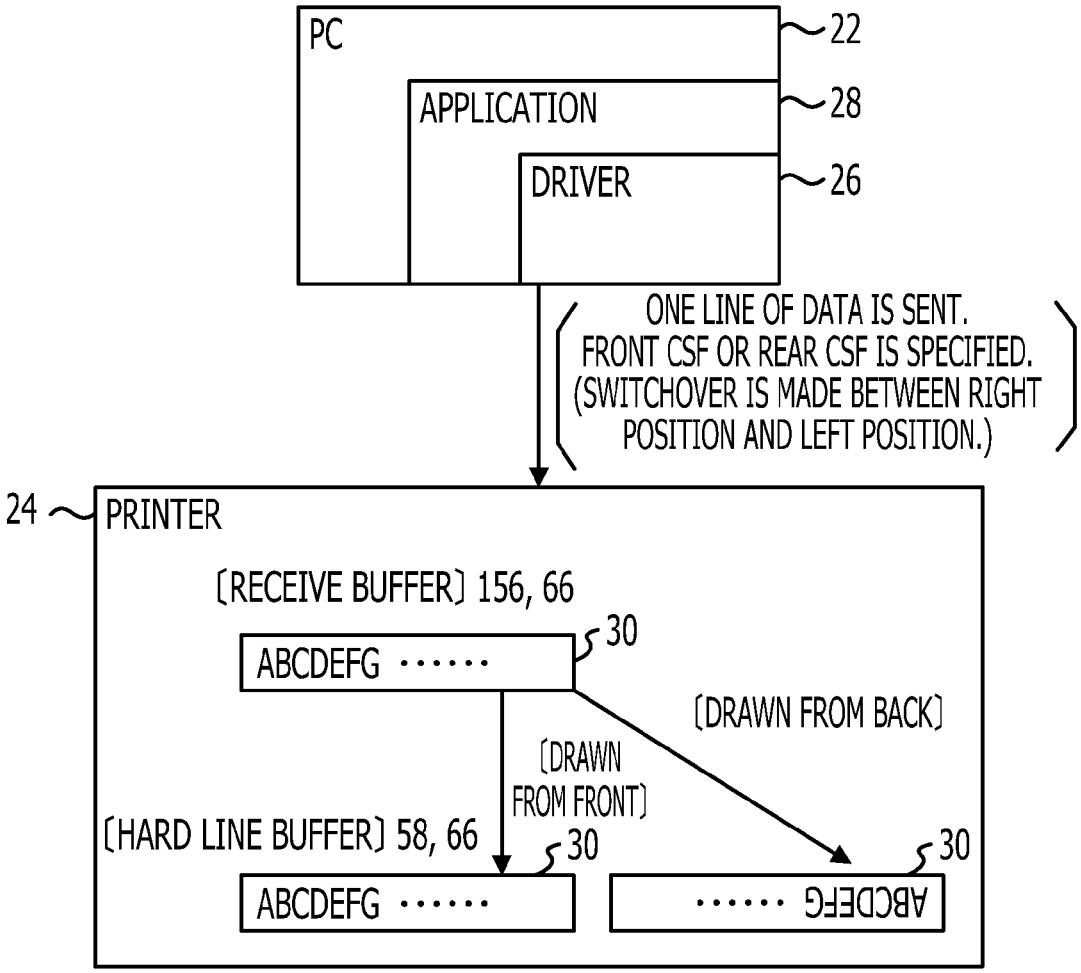
FIG. 16 illustrates an example of a state in which print data is being processed.
Figure 17:
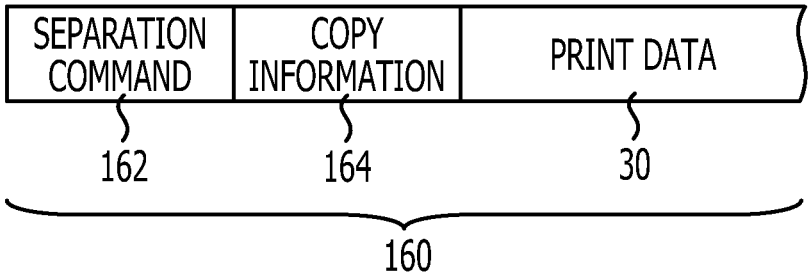
FIG. 17 illustrates an example of the data structure of printing control information sent from the PC to the printer.

FIG. 16 illustrates processing of print data and FIG. 17 illustrates a data structure. The processing and structure illustrated in FIGS. 16 and 17 are only examples; the present disclosure is not limited to this processing and structure.

The printer 24 in FIG. 16 receives printing control information, which includes print data 30, from the driver 26 and application 28 in the PC 22. The print data 30 includes, for example, one line of data, which is printed while the print head 70 is moving in the primary scanning direction. The printing control information 160 in FIG. 17 includes the print data 30 as well as a sectioning command 162 and copy information 164 in the header of the print data 30, for example. The sectioning command 162 includes information on a switchover between the right position and the left position by which the direction of printing by the print head 70 is indicated and also includes information that specifies the front CSF 76 or rear CSF 78.

The printer 24 stores, for example, the received print data 30 in a receive buffer 156 formed in the RAM 66 or the like. Many pieces of one line of print data 30 received from, for example, the PC 22 are stored in the receive buffer 156 in the order of printing. The orientation of the print data 30 stored in the receive buffer 156 is inverted according to the feed direction set in a printing control command, while the sequence of characters and the like of the print target are maintained, after which the inverted print data 30 is stored in a hard line buffer 158. The hard line buffer 158 is a storage area allocated in, for example, the RAM 66; the print data 30 to be printed by the print head 70 is stored in the hard line buffer 158.

Figure 18:
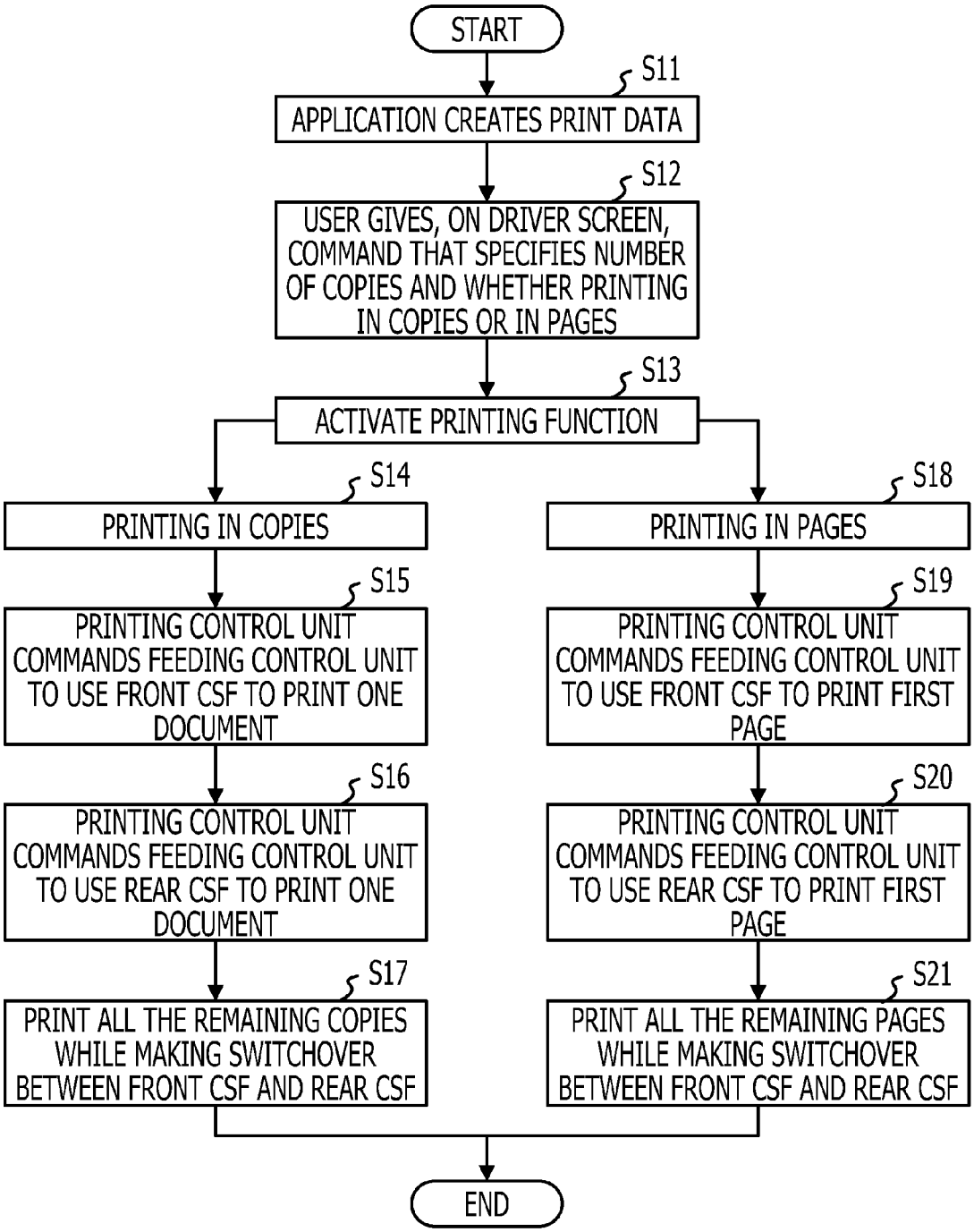
FIG. 18 is a flowchart illustrating an example of print processing.
Figure 19:
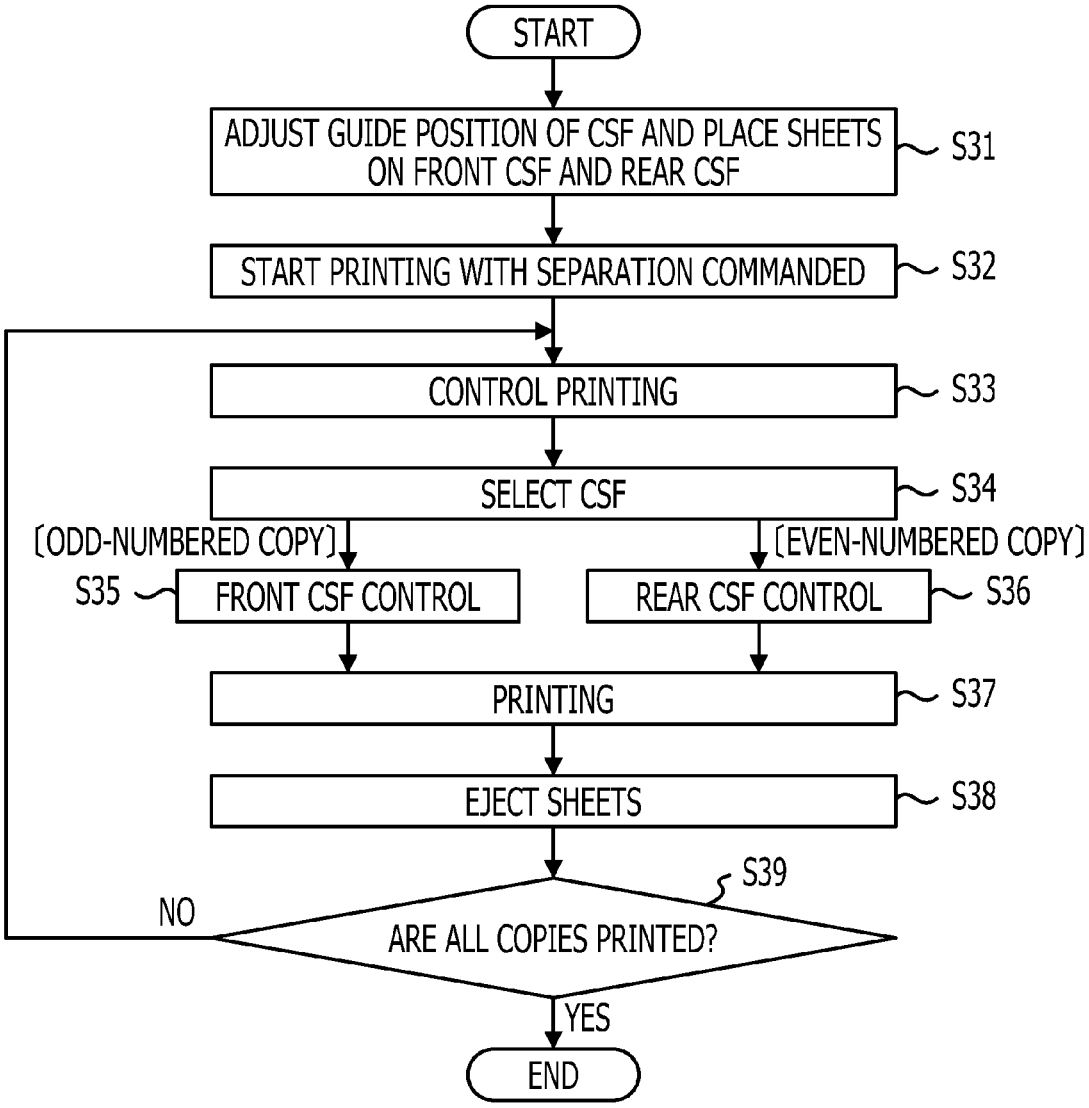
FIG. 19 is a flowchart illustrating another example of print processing.
Figure 20:
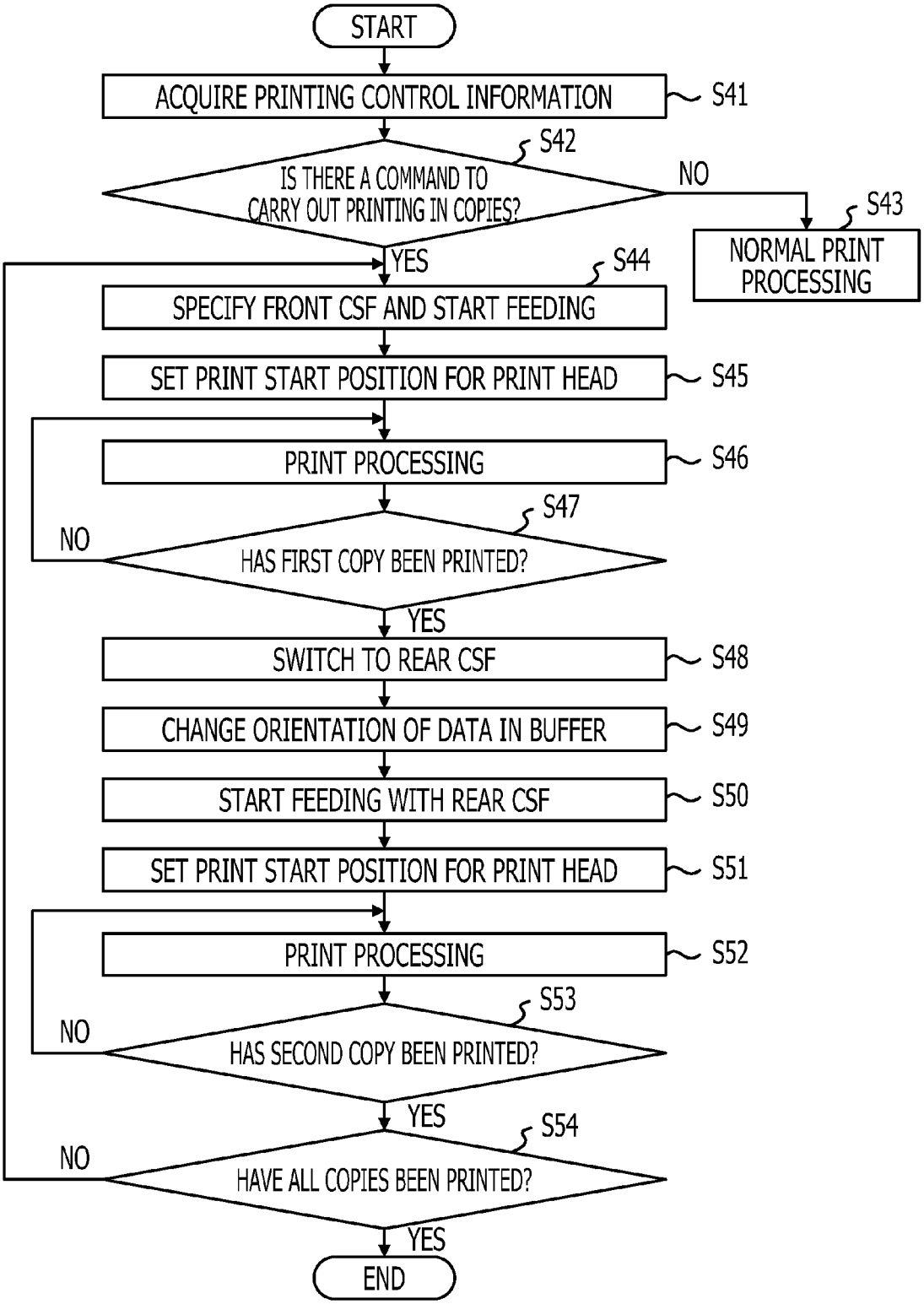
FIG. 20 is a flowchart illustrating an example of print processing executed by the printer.

FIGS. 18, 19, and 20 illustrate examples of printing processing. Processing and processing procedures in FIGS. 18 to 20 are only examples, and the present disclosure is not limited to the processing.

Figure 21:
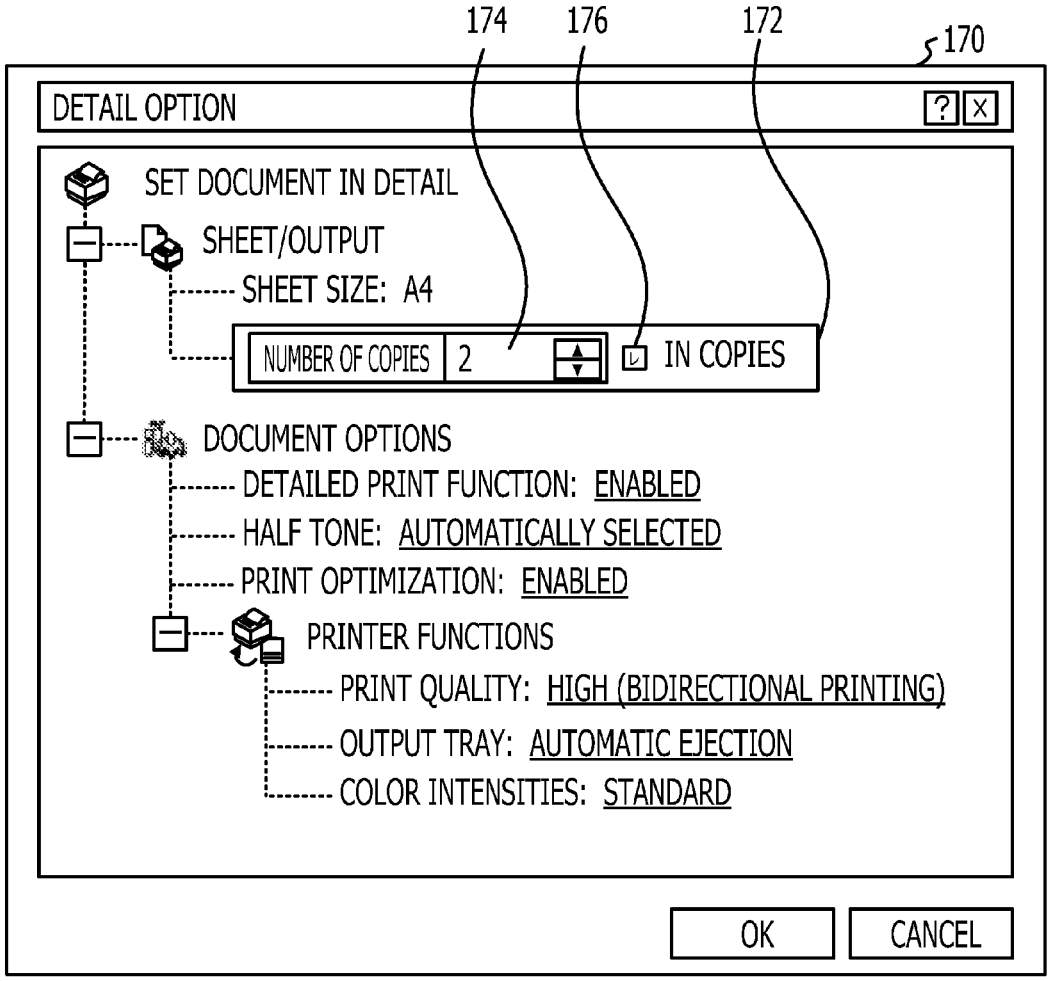
FIG. 21 illustrates an example of a display on a driver screen.

The print processing is an example of the printing control program in the present disclosure. The processing illustrated in FIG. 18 includes printing control processing executed by the printer system 20, which is positioned between the printer 24 and the PC 22 that functions as a host. In this processing, the application 28 in the PC 22 creates the print data 30 (S11). In the PC 22, the driver 26 is activated and the user gives, on a driver screen, a command that specifies the number of copies and whether printing is in copies or in pages (S12). The driver screen 170 illustrated in FIG. 21 is displayed on the display unit 50 (FIG. 5) of the PC 22 when the driver 26 is activated in response to, for example, an operation to start printing. The driver screen 170 includes print setting information intended for the printer 24.

The driver screen 170 includes, for example, a collating printing setting area 172, which sets printing in copies. The collating printing setting area 172 includes, for example, a copy count setting display area 174 and a sort specifying display area 176 that indicates per-copy sorting, in which copies are stacked by switching over between the front CSF 76 and the rear CSF 78. When the number of copies and the use or non-use of the sort function is set, the PC 22 sends the print data 30 and printing control information 160 to the printer 24 and activates the printing function (S13).

Printing in Copies

The printing control unit 32 of the PC 22 identifies that, for example, the setting information on the driver screen 170 has been referenced and printing in copies has been specified (S14). The printing control unit 32 commands, in the printing control information 160, the feeding control unit 34 in the printer 24 to use the front CSF 76 to print (S15).

When, for example, one copy has been printed, the printing control unit 32 commands, in printing control information 160 for the next copy, the feeding control unit 34 to use the rear CSF 78 to perform printing (S16).

The printer 24 then prints all the remaining copies while switching over between the front CSF 76 and the rear CSF 78 for each copy before printing for the current copy is performed (S17).

Printing in Pages

The printing control unit 32 of the PC 22 identifies that, for example, the setting information on the driver screen 170 has been referenced and printing in pages has been specified (S18). The printing control unit 32 commands, in the printing control information 160, the feeding control unit 34 in the printer 24 to use the front CSF 76 to print a first page (S19). When a plurality of copies are printed with printing in pages, each page is printed with the number of times equal to the number of copies.

When, for example, the first page has been printed, the printing control unit 32 commands, in printing control information 160 for the next page, the feeding control unit 34 to use the rear CSF 78 to perform printing (S20).

The printer 24 then prints all the remaining pages while switching over between the front CSF 76 and the rear CSF 78 for each page before printing for the current page is performed (S21).

In the processing illustrated in FIG. 19, the guide position of the CSF is adjusted in the printer 24 and the print sheets 14*a* and 14*b* are respectively placed on the front CSF 76 and rear CSF 78 (S31). The printer 24 starts printing in copies with sectioning commanded (S32).

The printer 24 references the printing control information 160 received from the PC 22 and reads a command to make a switchover between the front CSF 76 and the rear CSF 78 for each copy (S33). The printer 24 selects a CSF according to the switchover command (S34).

In the switching command, the front CSF 76 has been set for odd-numbered copies and the rear CSF 78 has been set for even-numbered copies, for example. Therefore, the feeding control unit 34 references the copy information 164 for the copy to be printed and selects a control command sent to the front CSF control unit 36 or rear CSF control unit 38 according to whether the copy is an odd-numbered copy or an even-numbered copy (S35, S36).

In the printer 24, print sheets 14 are fed from the selected CSF and printing is carried out (S37). The print sheets 14 on which printing has been carried out are ejected to the stacker 94 (S38).

The printer 24 references the printing control information 160 and checks whether all copies have been printed (S39). When printing has not been completed for all copies that had been set (the result in S39 is No), the sequence proceeds to S33. When printing has been completed for all copies (the result in S39 is Yes), the printing is terminated.

FIG. 20 illustrates a more specific example of the print processing executed by the printer 24.

When the printer 24 acquires printing control information 160 from the PC 22 functioning as a host (S41), the printer 24 determines whether the printing control information 160 includes a command to carry out printing in copies (S42). When a command to carry out printing in copies is not included (the result in S42 is No), print processing starts (S43); in the print processing, print sheets 14 are ejected without being sorted in the printing of only one copy or printing of a plurality of sheets of the same page.

When a command to carry out printing in copies is included (the result in S42 is Yes), print processing for a first copy is carried out, for example. In print processing, the feeding control unit 34 outputs a control command to the front CSF control unit 36 and the front CSF 76 starts feeding (S44). The printing unit 12 detects the presence or absence of the print sheet 14*a*, the reference point P1 an edge of the print sheet 14*a*, and the like by using, for example, the sheet width sensor 82A and sets a print start position for the print head 70 (S45).

The print head 70 performs printing by moving in the primary scanning direction, that is, from the left end of the print sheet 14*a* toward the right edge (S46). The printer 24 then determines whether a first copy has been printed (S47). When the first copy has not been printed (the result in S47 is No), print sheets 14*a* are fed from the front CSF 76 until all pages of the first copy setting have been printed.

When the first copy has been printed (the result in S47 is Yes), the feeding control unit 34 outputs a feed command to the rear CSF control unit 38 to switch to the rear CSF 78 (S48). In the RAM 66, the orientation of the print data 30 stored in, for example, the receive buffer 156 is rotated and the rotated print data 30 is stored in the hard line buffer 158 (S49).

When the print sheet 14*b* is fed from the rear CSF 78 (S50), the printing unit 12 detects the presence or absence of the print sheet 14*b*, the reference point P2 an edge of the print sheet 14*b*, and the like by using, for example, the sheet width sensor 82B and sets a print start position for the print head 70 (S51).

The print head 70 prints by moving in the primary scanning direction, that is, from the left edge of the print sheet 14*b* toward the right edge (S52). The printer 24 then determines whether a second copy has been printed (S53). If the second copy has not been printed (the result in S53 is No), print sheets 14*b* are fed from the rear CSF 78 until all pages of the second copy setting have been printed.

If the second copy has been printed (the result in S53 is Yes), the printer 24 determines whether all copies have been printed (S54). If there is a print command from the PC 22 to print a third copy (the result in S54 is No), the sequence proceeds to S44 and printing in copies is repeated.

Although, in this print processing, a case in which the front CSF 76 has been used in the printing of the first copy and the rear CSF 78 has been used in the printing of the second copy, this not a limitation; for example, the rear CSF 78 may be used in the printing of the first copy and the front CSF 76 may be used in the printing of the second copy.

In the structure described above, a plurality of feeders, on which feed positions have been set so that ejection positions are shifted from each other and thereby ejected print sheets overlap, are switched for each print job of one copy or one page, so the ejected print sheets may be easily sectioned. Alternatively, the orientation of print data is rotated for a print sheet that is fed in the direction opposite to the direction of a counterpart, and the print data is printed by switching the direction in which the print head moves, so that the print direction on the print sheet to be ejected is changed for each copy, enabling the ejected sheets to be easily sectioned. This printer does not use a feed direction changing mechanism in processing to recompose print data recomposing processing or before and after print processing, thereby enabling the sectioning function to be improved with a simple structure.

Third Embodiment

Figure 22:
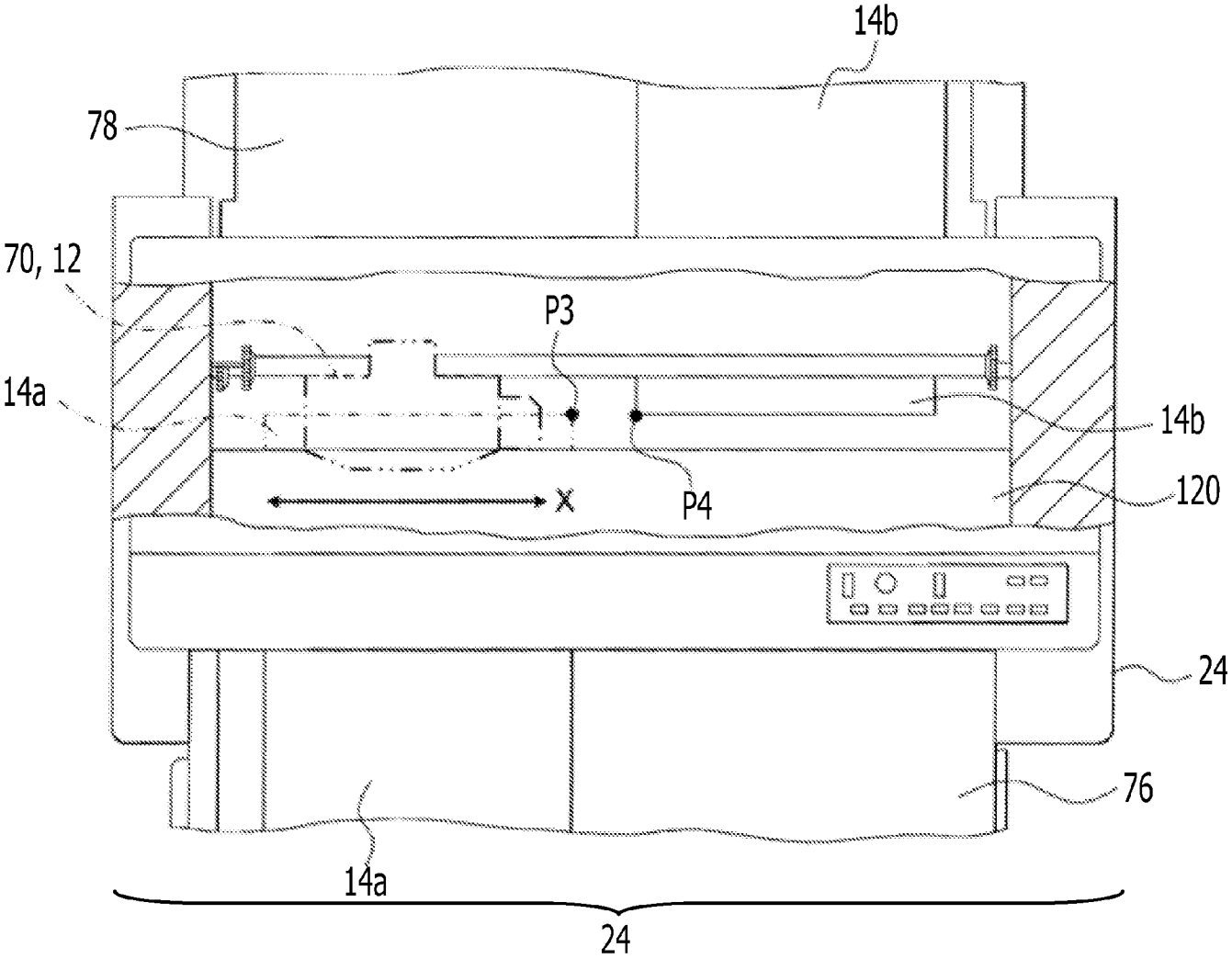
FIG. 22 illustrates an example of a sheet feed state according to a third embodiment.

FIG. 22 illustrates an example of a sheet feed state according to a third embodiment. The structure illustrated in FIG. 22 is only an example; the present disclosure is not limited to this structure.

With the printer 24 in FIG. 22, decision processing may be carried out to decide whether feed positions have been set so that the print sheet 14*a* placed on the front CSF 76 and the print sheet 14*b* placed on the rear CSF 78 overlap on the stacker 94 (FIG. 15). This decision processing to decide the feed positions is executed by using, for example, the sheet width sensors 82A and 82B on the print head 70 (FIG. 10).

The sheet width sensors 82A and 82B detect a reference position P3 at the right edge of the print sheet 14*a* transported to the print head 70 and a reference point P4 at the left edge of the print sheet 14*b*, for example. The feeding control unit 34 in the printer 24 calculates an amount by which the print sheets 14*a* and 14*b* overlap at the time of feeding according to, for example, information about the detected positions.

Whether the print sheets 14*a* and 14*b* ejected to the stacker 94 partially or completely overlap is decided according to the amount of overlap. The printer 24 grasps a position to which the print head 70 moves in the primary scanning direction or an amount by which the print head 70 moves in advance, for example, so the feeding control unit 34 calculates the amount by which the print sheets 14*a* and 14*b* overlap from the reference position P3 on the print sheet 14*a* and the reference point P4 on the print sheet 14*b*. For example, the feeding control unit 34 determines whether the reference point P3 has been detected on the right side of the reference point P4. The distance detected between the reference point P3 and the reference point P4 is calculated as the amount of overlap. With the printer 24 in FIG. 22, the reference point P3 has been detected on the left side of the reference point P4 and the print sheets 14*a* and 14*b* are not overlapping, so the amount of overlap is calculated as 0.

Figure 23:
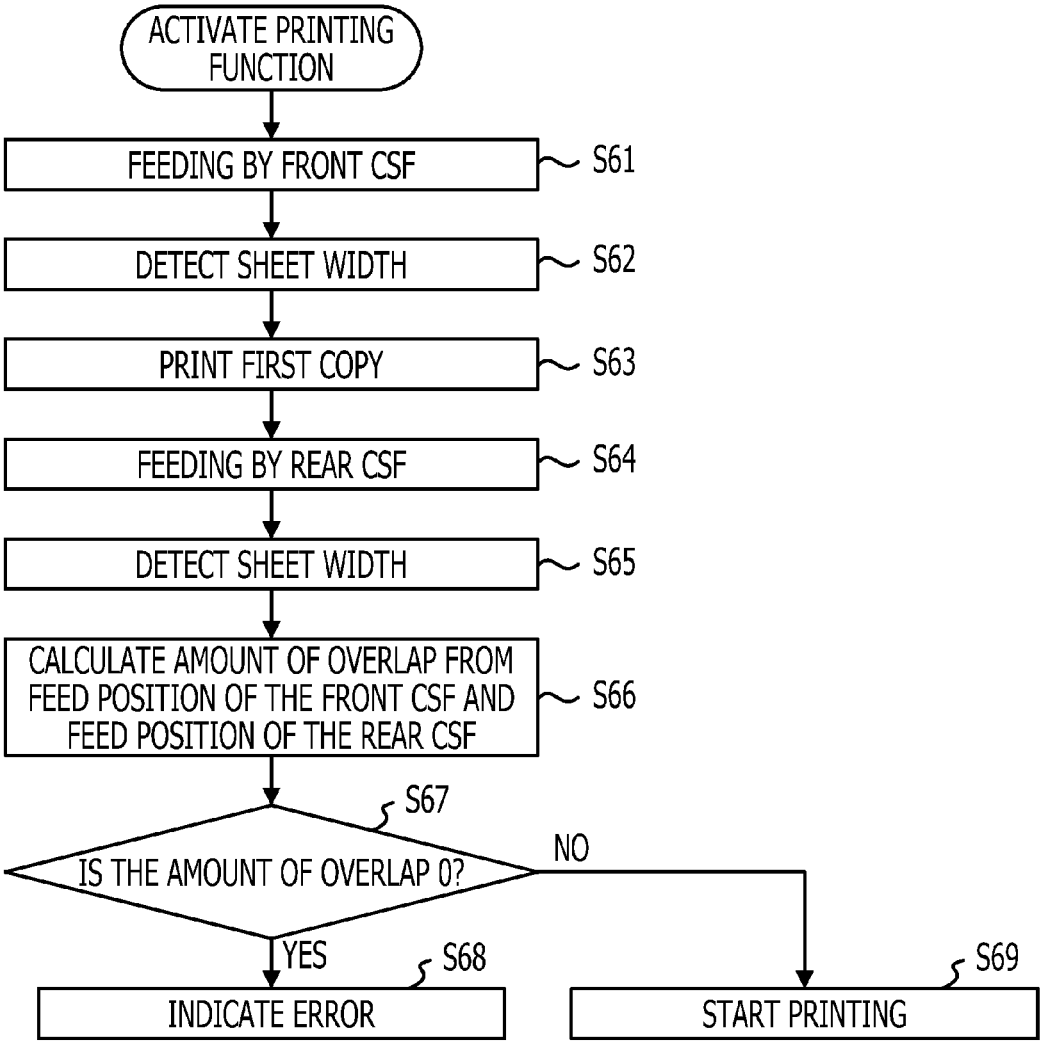
FIG. 23 is a flowchart illustrating an example of printing control.

FIG. 23 illustrates an example of printing control that includes a decision on whether print sheets 14 overlap. The processing and processing procedure in FIG. 23 are only an example; the present disclosure is not limited to the below processing.

The printing control is an example of processing executed by the printing control program in the present disclosure. When the printer 24 receives printing control information 160 that includes information about printing in copies from, for example, the PC 22, and activates the print function, the front CSF 76 starts to feed the print sheet 14*a* (S61). The print head 70 detects the width of the fed print sheet 14*a* as preparation for print processing (S62). In the detection of the sheet width, the reference point P1 (FIG. 13) at the left edge of the print sheet 14*a* and the reference point P3 at the right edge are detected by using, for example, the sheet width sensor 82A and the reference points P1 and P3 are stored.

After the sheet width information has been detected, the printer 24 uses the front CSF 76 to prints a first copy (S63).

Upon completion of the printing of the first copy, the printer 24 proceeds to print processing of a second copy. The feeding control unit 34 of the printer 24 switches to the rear CSF 78, causing the rear CSF 78 to start to feed the print sheet 14*b* (S64).

The print head 70 detects the width of the fed print sheet 14*b* (S65). In the detection of the sheet width, the reference point P2 (FIG. 14) at the right edge of the print sheet 14*b* and the reference point P4 at the left edge are detected by using, for example, the sheet width sensor 82B and the reference points P2 and P4 are stored.

The printer 24 calculates an amount by which the print sheet 14*a* and print sheet 14*b* overlap (S66). Specifically, the feeding control unit 34 calculates the amount of overlap from the stored information regarding the feed position on the front CSF 76 and the feed position on the rear CSF 78.

The feeding control unit 34 then determines whether the calculated amount of overlap is 0 (S67). If the amount of overlap is 0 (the result in S67 is Yes), the print sheet 14*b* will not overlap the print sheet 14*a*, which has been already ejected to the stacker 94, even if the print sheet 14*b* is fed, undergoes print processing, and is ejected. Accordingly, the printer 24 indicates an error on, for example, the display unit 88 (FIG. 5) of the printer 24 and suspends or cancels the printing (S68). The printer 24 may notify the PC 22 functioning as a host, for example, which has output a print command, of the error and the PC 22 may indicate the error on the display unit 50 (FIG. 5) or the like.

If the amount of overlap is not 0 (the result in S67 is No), this indicates that the print sheet 14*b* has been placed so that when the print sheet 14*b* is fed, the print sheet 14*b* will partially or completely overlap the print sheet 14*a* that has already undergone print processing and has been ejected to the stacker 94. Accordingly, the printer 24 starts print processing (S69).

If the feed position is adjusted on the rear CSF 78, the printer 24 may recalculate the amount of overlap and may decide whether to start printing.

In the structure described above, the amount of overlap may be calculated from the feed positions set on the front CSF 76 and rear CSF 78 before printing is started, so printing is carried out only when the print sheet 14*a* and print sheet 14*b* will overlap on the stacker 94. Accordingly, reliability may be increased in the sectioning of printed copies and the convenience of the printer 24 may be improved.

Another Embodiment

Although, in the embodiments described above, the front CSF 76 and rear CSF 78 have been placed at the front and back of the printer 2, this is not a limitation. The printer 2 may be structured in any way in which print sheets 14 that have been fed from the first feeder 4 and second feeder 6 overlap in the same direction at the time of ejection. For example, the first feeder 4 and second feeder 6 may feed print sheets 14 from the right and left sides of the printer 2. Alternatively, the first feeder 4 and second feeder 6 may be placed vertically at the front or back of the printer 2.

Although preferable embodiments and the like of the present disclosure have been described above, the present disclosure is not limited to the above descriptions. Those skilled in the art may make many variations and changes according to the spirit and scope of the disclosure described in the claims or the description. It is to be understood that these variations and changes are included in the range of the present disclosure.

All examples and conditional language recited herein are intended for pedagogical purposes to aid the reader in understanding the invention and the concepts contributed by the inventor to furthering the art, and are to be construed as being without limitation to such for example recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A printer comprising:

a first feeder that feeds a first sheet;

a second feeder that feeds a second sheet, a feed position on the second feeder being set so that the second sheet overlaps the first sheet when the second sheet is ejected;

a stacker that collects the first sheet and the second sheet on which printing has been carried out so that the first sheet and the second sheet overlap; and a processor that determines whether a sectioning command is included in a print request, and when a sectioning command is included, switches over between the first feeder and the second feeder for each print job; and a printing unit that selects a first scanning direction during according to feed directions of the first feeder and the second feeder, wherein the processor rotates an orientation of print data according to the feed directions and causes the printing unit to print the print data.

2. The printer according to claim 1, wherein either or both of the first feeder and the second feeder has a mechanism that adjusts a position at which the relevant sheet is placed.

3. The printer according to claim 1, wherein the first sheet fed from the first feeder and the second sheet fed from the second feeder are of the same size and are oriented in the same direction.

4. The printer according to claim 1, wherein an orientation of a printed surface of the first sheet or the second sheet is changed so that the printed surfaces of the first sheet and the second sheet have a difference of 180 degrees in orientation before the first sheet and the second sheet are collected on the stacker.

5. The printer according to claim 1, further comprising a sensor that detects edges of the first sheet and the second sheet, wherein the sensor identifies print start positions on the first sheet and the second sheet and controls printing of the printing unit according to detection information obtained from the sensor.

6. The printer according to claim 5, wherein the processor outputs notification information when the processor determines that the first sheet and the second sheet on which printing has been carried out will be placed on the stacker at positions at which the first sheet and the second sheet will not overlap.

7. A printing control method comprising:

determining whether a sectioning command is included in a print request;

switching over between a first feeder and a second feeder, on which feed positions have been set so that sheets that have been ejected are overlap, for each print job according to a result obtained by the determination of whether a sectioning is included in the print request;

changing a scanning direction in printing according to a direction of sheet feed from the first feeder or the second feeder; and rotating an orientation of print data according to the direction of sheet feed.

8. The printing control method according to claim 7, further comprising:

reading positional information about ends of the sheets placed on the first feeder and the second feeder;

identifying print start positions on the sheets according to the positional information; and outputting notification information when sheets placed on the first feeder and the second feeder will not overlap after the first sheet and the second sheet are ejected.

9. A non-transitory computer-readable recording medium having stored therein a program for causing a computer to execute a digital signal process, wherein the digital signal process comprising:

determining whether a sectioning command is included in a print request;

switching over between a first feeder and a second feeder, on which feed positions have been set so that sheets that have been ejected overlap, for each print job according to a result obtained by the determining; changing a scanning direction in printing according to a direction of a sheet feed from the first feeder or the second feeder; and rotating an orientation of print data according to the direction of sheet feed.

10. The non-transitory computer-readable recording medium according to claim 9, wherein the digital signal process further comprising:

retrieving positional information about ends of the sheets placed on the first feeder and the second feeder;

identifies print start positions on the sheets according to the positional information; and outputting notification information in a case in which the sheets placed on the first feeder and the second feeder will not overlap after the first sheet and the second sheet have been ejected.

* * * * *